US012104451B2

(12) United States Patent
Mehta et al.

(10) Patent No.: US 12,104,451 B2
(45) Date of Patent: Oct. 1, 2024

(54) ACTUATABLE OBSTRUCTION MEMBER FOR CONTROL LINES

(71) Applicant: HALLIBURTON ENERGY SERVICES, INC., Houston, TX (US)

(72) Inventors: Manan Ravindra Mehta, Singapore (SG); Kalvin Bai, Singapore (SG); Preetham Halasinahally Ningegowda, Singapore (SG); Huili Shen, Singapore (SG); Abhay Raghunath Bodake, Singapore (SG); Ratish Kadam, Singapore (SG); Mukesh Bhaskar Kshirsagar, Singapore (SG); Mohan Gunasekaran, Singapore (SG); Wee Kiang Jeremy Lau, Singapore (SG); Fangzhou Zhou, Singapore (SG); Zun Kai Chiam, Singapore (SG); Mathusan Mahendran, Singapore (SG)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 178 days.

(21) Appl. No.: 17/311,224

(22) PCT Filed: Jan. 7, 2019

(86) PCT No.: PCT/US2019/012540

§ 371 (c)(1),
(2) Date: Jun. 4, 2021

(87) PCT Pub. No.: WO2020/145938

PCT Pub. Date: Jul. 16, 2020

(65) Prior Publication Data

US 2022/0025732 A1 Jan. 27, 2022

(51) Int. Cl.
*E21B 33/13* (2006.01)
*E21B 34/14* (2006.01)

(52) U.S. Cl.
CPC ..... *E21B 33/13* (2013.01); *E21B 34/14* (2013.01); *E21B 2200/06* (2020.05)

(58) Field of Classification Search
CPC ..... E21B 33/13; E21B 34/14; E21B 34/00; E21B 34/10; E21B 2200/05;
(Continued)

(56) References Cited

U.S. PATENT DOCUMENTS 1,704,152 A 3/1929 Stephens et al.
6,070,668 A 6/2000 Parks et al.
(Continued)

FOREIGN PATENT DOCUMENTS

WO 2017058249 A1 4/2017

OTHER PUBLICATIONS

International Search Report and Written Opinion, PCT Application No. PCT/US2019/012540, dated Oct. 7, 2019.

*Primary Examiner* — Caroline N Butcher
(74) *Attorney, Agent, or Firm* — NOVAK DRUCE CARROLL LLP

(57) ABSTRACT

A tubular control conduit is disposed in a wellbore having a retractable segment and an abandonable segment, each having an inner bore. Upon retraction of the retractable segment an obstruction member is actuated to form a seal thereby preventing the flow of fluid past the obstruction member in the inner bore of the abandoned segment. Cement is then poured into the wellbore thereby covering the abandoned segment of the tubular control conduit.

18 Claims, 18 Drawing Sheets

(58) Field of Classification Search
CPC .... E21B 2200/04; E21B 33/134; E21B 34/06; E21B 2200/06
See application file for complete search history.

(56) References Cited

U.S. PATENT DOCUMENTS

| | | | | |
|---|---|---|---|---|
| 8,499,843 | B2 | 8/2013 | Patel et al. | |
| 8,622,085 | B2 | 1/2014 | June | |
| 9,103,182 | B2 | 8/2015 | Sinnott et al. | |
| 10,704,152 | B2 * | 7/2020 | Holland | C25B 15/08 |
| 2005/0126789 | A1 | 6/2005 | Nivens et al. | |
| 2009/0250228 | A1 | 10/2009 | Loretz et al. | |
| 2014/0326470 | A1 * | 11/2014 | Tinnen | E21B 33/134 166/241.5 |
| 2016/0010430 | A1 * | 1/2016 | Myerley | E21B 34/102 166/332.1 |
| 2019/0257174 | A1 * | 8/2019 | Andreychuk | E21B 34/14 |

* cited by examiner

ACTUATABLE OBSTRUCTION MEMBER FOR CONTROL LINES

CROSS-REFERENCE TO RELATED APPLICATIONS

This application is a national stage entry of PCT/US2019/012540 filed Jan. 7, 2019, said application is expressly incorporated herein by reference in its entirety.

TECHNICAL FIELD

The present technology relates to the wellbore abandonment phase. In particular, the present technology involves sealing downhole control lines for abandoning the wellbore.

BACKGROUND

For control of various downhole tools, small diameter tubular control conduits (also referred to as control lines) may run along with production tubing, or other tubulars, into a wellbore. Given the control by these tubular control conduits, these may be referred to as intelligent wells. The tubular control conduits may include fluids or electrical lines for communicating control signals to the downhole tools. As the control lines extend downhole they may be external to the production tubing and downhole tools, but may at various points pass through them, or may be connected by fittings to ports, channels or bores within the tubing and tools.

After the wellbore has undergone production and hydrocarbons extracted, the wellbore may then be abandoned. The abandonment phase involves processes to close the well and make it safe to the environment when left alone. Accordingly, in this phase a portion of the upper tubing may be removed and cement injected to isolate the wellbore and prevent the flow of fluids into unwanted regions, such as freshwater aquifers. The small diameter control lines may fail to be plugged with the cement during this process and therefore correspondingly fail to prevent unwanted fluid loss.

BRIEF DESCRIPTION OF THE DRAWINGS

The embodiments herein may be better understood by referring to the following description in conjunction with the accompanying drawings in which like reference numerals indicate analogous, identical, or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
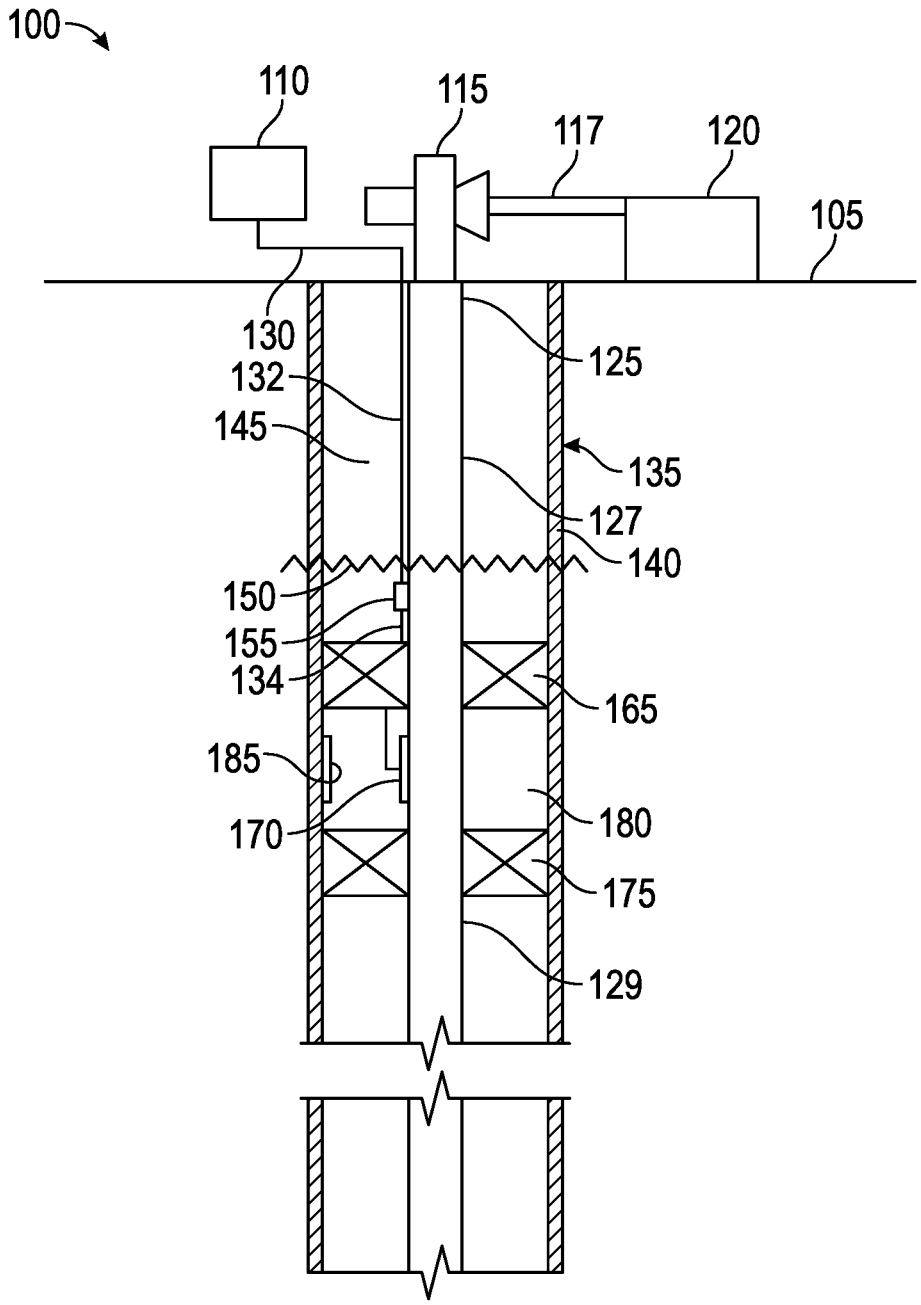
FIG. 1A is a schematic diagram of an exemplary wellbore environment.

Various embodiments of the disclosure are discussed in detail below. While specific implementations are discussed, it should be understood that this is done for illustration purposes only. A person skilled in the relevant art will recognize that other components and configurations may be used without departing from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

During the production phase of a wellbore, small diameter tubular control conduits (also referred to as control lines in the field) are employed to transmit communication signals, such as control signals, and power (hydraulic, electrical, or other) to various downhole tools. The tubular control conduits are provided parallel with production tubulars and reside, at least partially, in the annulus of the wellbore. Wellbore production involving the extraction of hydrocarbons to the surface, is carried out until the production is too low or non-existent, and then the wellbore is abandoned.

During the abandonment phase, various tools and upper portions of tubulars may be retracted and removed from the wellbore. However, the lower portion of tubulars and other downhole tools may be left for permanent abandonment in the well. The wellbore may then be plugged. Mechanical plugs (e.g., bridge plugs) may be provided downhole and production tubulars cemented to prevent crossflow or unwanted production. There are also regulatory requirements which may require implementation of primary and secondary barriers downhole.

Due to the small diameter of tubular control conduits, cement may not effectively enter and seal them off. If unsuccessful, the tubular control conduits may be potential leak paths through multiple barriers (such as packers or bridge plugs) in the wellbore. This may result in harm to the environment.

Accordingly, disclosed herein is an apparatus, method and system for sealing a tubular control conduit for well abandonment. In particular, an obstruction member may be actuated which may enter the inner bore of the tubular control conduits, forming a seal and blocking any flow of fluids out from the tubular control conduits. The obstruction member may be actuated by retracting an upper retractable segment of the tubular control conduit which places it under tension (longitudinal tensile strength in the uphole direction), while the lower abandoned segment is sealed by the obstruction member. The terms "uphole" and "downhole," as used herein, are relative to the bottom or furthest extent of the wellbore, even though the wellbore or portions of it may be deviated or horizontal. The obstruction member may take a plurality of forms. For instance, the obstruction member may have a spherical shape, or other shape, such as cubical, or other polyhedron. The obstruction member may have a flowbore and can be actuated to rotate or reorient thereby closing the flowbore to the inner bore of the abandoned segment of the tubular control conduit. Some obstruction members may also be without any flowbore and may be urged into a position within the inner bore of the abandoned segment by a biasing member such as a spring to block flow. The obstruction member may be a deformable member, such as a collet which deforms to provide a seal within the inner bore of the abandoned segment. Further, the obstruction member may be a resin, which is injected through perforations made in the tubular control conduits. Other than resins or elastomers disclosed herein, the obstruction member may form a metal-to-metal seal when actuated, thereby forming a more robust seal.

FIG. 1A is a schematic of an exemplary wellbore environment 100 for implementation of the actuatable obstruction apparatus disclosed herein. As illustrated, is a wellbore 135 having production tubular 125 extending from a wellhead 115 at surface 105. The production tubular 125 may be made up of a plurality of individual tubulars connected together, which in the field may be referred to as joints. A casing 140 runs along a length of the wellbore 135 and may be cemented in place. The wellhead 115 has valves, pumps and components for maintaining pressure and withdrawing produced hydrocarbon into container 120 via piping 117 (or other tubular). Within the wellbore 135 may be packers 165 and 175 which may be set along the length of the production tubular 125 to prevent fluid flow and to isolate zones, such as zone 180.

A tubular control conduit 130 (may also be referred to as a control line in the field) extends from control device 110 at the surface 105 into the wellbore 135. The tubular control conduit 130 communicatively couples with a downhole tool 170. Communication signals and power may be transmitted between the control device 110 and the downhole tool 170, with such communication signals including control (command) signals from the control device 110 and power in the form of electricity or hydraulic pressure and fluid flow. The tubular control conduit 130 has an inner bore extending along it length which may contain a fluid or a conductor such as a wire, or conductive metal. Communication signals may be transmitted along the tubular control conduit 130 via the fluid or electrically via the conductor. When transmitted electrically, tubular control conduit 130 may be or may include a wire, cable or other conductor and may include a conductive metal. The tubular control conduit 130 runs adjacent and generally parallel to the production tubular 125 within the annulus 145 between the production tubular 125 and casing 140 (or surface of the wellbore 135 in uncased portions of the well). The tubular control conduit 130 may pass through the packer 165, or may couple with ports on the packer which carry the fluid or electrical signal through the packer 165, or otherwise have conduits for transmitting signal electrically or fluidically. Although one control conduit 130 is shown, there may be employed a plurality and any number, size, or type of control conduits 130.

The downhole tool 170 may be actuated by the control device 110 via signal transmitted along the tubular control conduit 130. The downhole tool may be any number of tools which communicate with the surface and receive command signals, and may be a valve, or actuator which actuates (opens or closes) a valve in the production tubular 125, or opens a door 185 in the casing 140 or otherwise actuates or carries out a job or activity in the production tubular 125, wellbore 135, and/or casing 140.

As mentioned, hydrocarbons may be extracted and produced via the production tubular 125 to the surface 105. After period of time, the produced hydrocarbon may be too low or the costs of production too high to extract the hydrocarbon. At this time, or for any other reason requiring closing of the wellbore 135, the well may be prepared for abandonment. This abandonment phase may involve the retraction of an upper portion of the tubulars, including production tubulars 125 and tubular control conduit 130. Other equipment and downhole tools may also be removed. As illustrated in FIG. 1A the cross-section 150 may be the position at which the tubulars, including the production tubulars 125 and tubular control conduit 130, may be retracted (i.e., withdrawn) and removed. Retraction may involve severing the tubulars, which may be carried out by cutting or by simply pulling with sufficient force, and/or additionally, placing weak points or severing points along the length of the tubular control conduit at which the tubulars may be severed. Additionally, severing may include pulling them from connections such as sealing devices (e.g., ferrule type connections). In the example shown, the cross-section 150 is just above the packers 165 so as to assist in isolating fluid further downhole.

The tubular control conduit 130 has an upper retractable segment 132 above the cross-section 150 and a lower abandonable segment 134 below the cross-section 150. When severed at the cross-section 150, the retractable segment 132 may be removed and the abandonable segment 134 may be left for permanent abandonment in the wellbore 135. The abandonable segment 134 has an actuatable obstruction apparatus 155 proximate (near) to the cross-section 150 where the tubular control conduit 130 will sever. Similarly, the production tubular 125 may also have an upper retractable segment 127 for removal above the cross-section 150 and a lower abandonable segment 129 to be left abandoned in the wellbore 135.

Figure 1B:
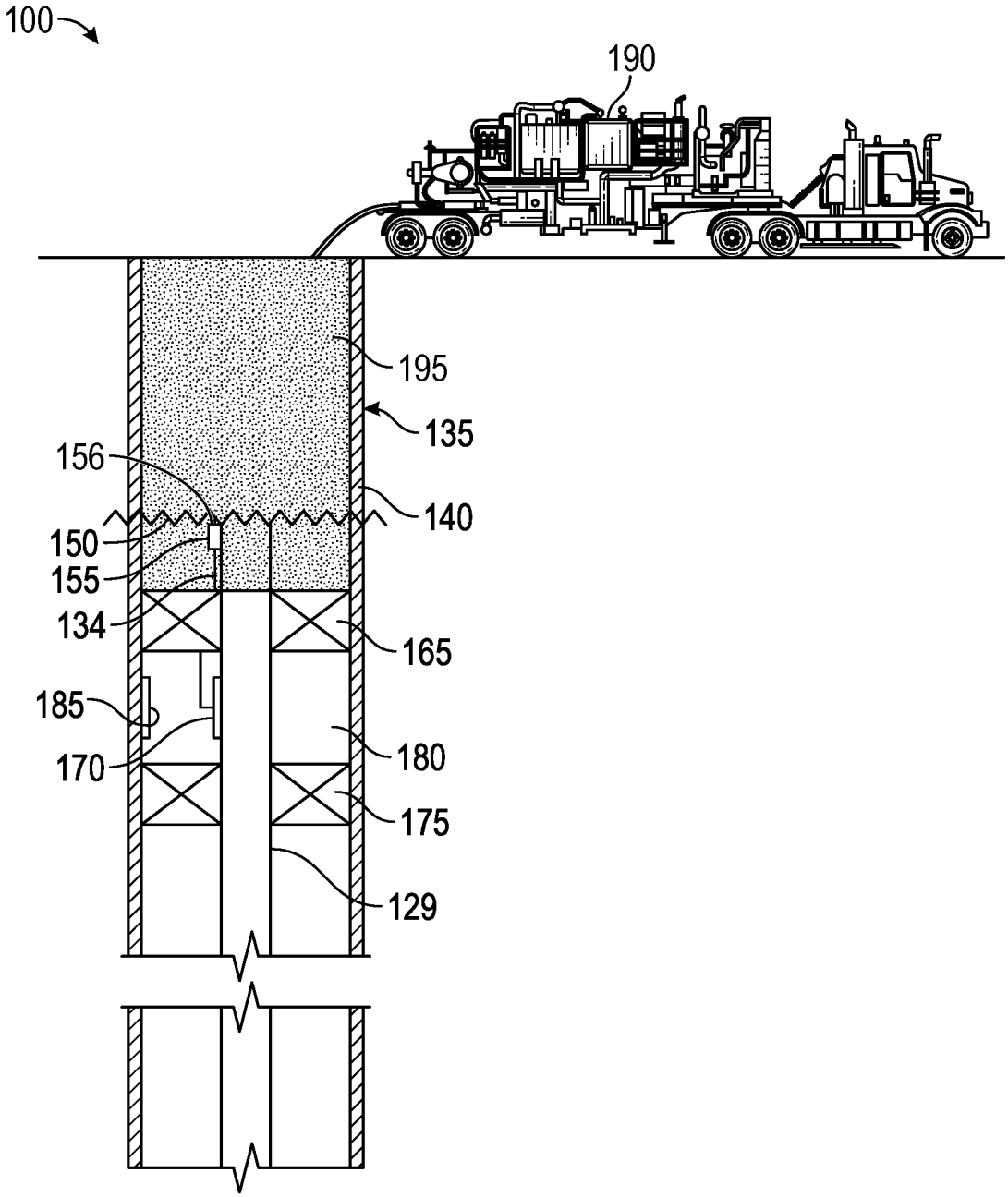
FIG. 1B is a schematic diagram of the exemplary wellbore environment of FIG. 1A after plugging.

FIG. 1B is a schematic of the wellbore environment 100 after plugging. In particular, cement 195 may be introduced, via pump for instance, into the wellbore 135. A cement truck 190 or other container or blending equipment may provide the cement 195. The cement 195 assists in plugging and preventing the flow of fluid. However, the diameter of the inner bore of the abandonable segment 134 may be of a small size such that the cement 195 has difficulty entering and plugging the inner bore of the abandonable segment 134. If the tubular control conduit 130 is not properly plugged, then fluid may pass between the various abandonable segments 134 and by extension, between the various isolated zones in the wellbore 135 along the length of the abandonable segment 134 and may enter unwanted regions and/or harm the environment.

In order to assure sealing of the tubular control conduit 130, the tubular control conduit 130 may have an actuatable obstruction apparatus 155 as illustrated in FIG. 1A. The actuatable obstruction apparatus 155 may have an obstruction member that may seal or block the inner bore of the tubular control conduit 130 when actuated. The actuation can be carried out via retracting the tubular control conduit 130, or activating by control signal via other tubular control conduits, or by particular predetermined manipulations of the tubular control conduit 130 (such as a jarring sequence). The cement 195 is poured to cover both the abandonable segment 134 and its exit mouth 156 (the uphole facing opening to the abandonable segment 134) as well as abandonable segment 129. Various embodiments of the actuatable obstruction apparatus 155 and/or obstruction members are illustrated in the following FIGS. 2A-9E.

Figure 2A:
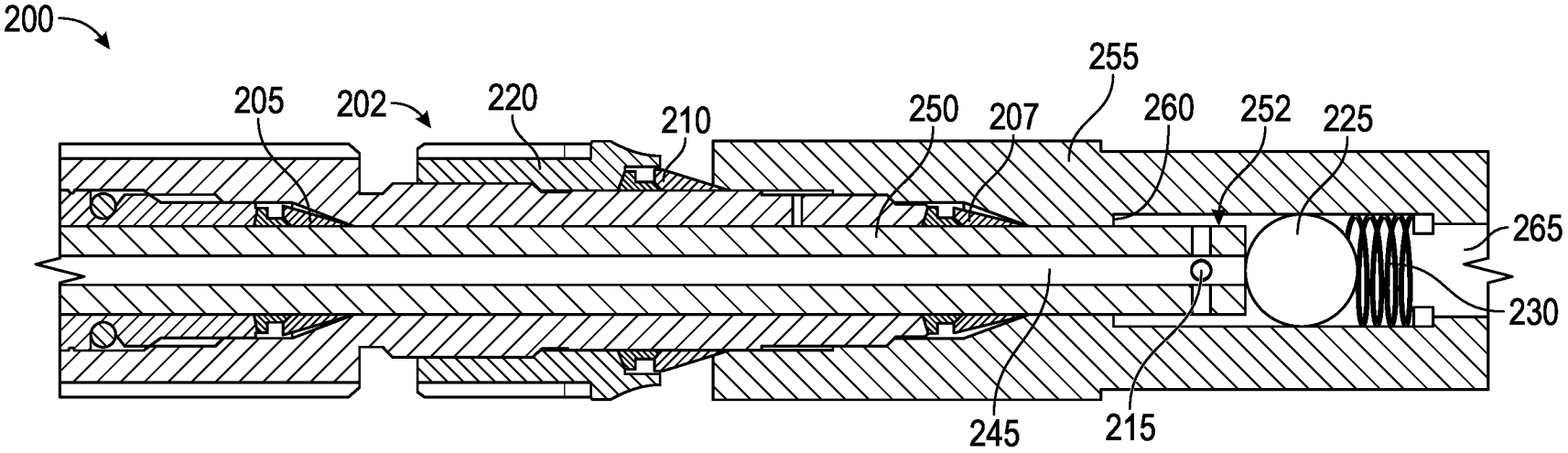
FIG. 2A is a cross-sectional view of an exemplary actuatable obstruction apparatus in an unactuated configuration having a biasing member and an openable flowbore.

FIG. 2A is a cross-sectional view of the actuatable obstruction apparatus 200 in an unactuated configuration. As illustrated therein, there is a retractable segment 250 of control conduit 130 (shown in FIG. 1A) having inner bore 245, and an abandonable segment 255 (also referred to as an abandoned segment) having inner bore 265. A seal coupling device 202 may be provided at the end of the retractable segment 250. The seal coupling device 202 may provide a metal-to-metal seal, and may be a ferrule type tubing connector, for instance a triple ferrule metal-to-metal seal connector, and may also include couplings with a SWAGELOK™ fitting. Commercially available seal coupling devices include the FMJ connector by Halliburton Energy Services, Inc. which permits a metal-to-metal seal. The seal coupling device 202 may have an inner seal 205 which seals around the retractable segment 250, a middle seal 210, and a distal seal 207 for sealing the distal end of the seal coupling device 202 with the retractable segment 250, along with a rotatable handle 220 for tightening the device.

The inner bore 265 of the abandonable segment 255 has a shoulder seat 260 (which may also be referred to as a seat). The distal end 252 of the retractable segment 250 has outlet 215 which permits outflow of fluid from the inner bore 245 of the retractable segment 250 into the inner bore 265 of the abandonable segment 255. The outlet 215 may be formed with employment of ports and/or a castle nut having grooves for outflow of fluid. An obstruction member 225 may be provided within the inner bore 265. The obstruction member 225 may be a ball, or any spherical object, poppet, dart, or other shape which may obstruct the flow of fluid when actuated. In the unactuated configuration of actuatable obstruction apparatus 200, the distal end 252 of the retractable segment 250 maintains the obstruction member 225 against a biasing member 230 (which may be a coiled spring) and away from the shoulder seat 260. The biasing member 230 correspondingly urges the obstruction member 225 against the distal end 252 of the retractable segment 250. When relieved from the shoulder seat 260 fluid flow from the outlet 215 may enter the inner bore 265 and flow around the obstruction member 225.

Figure 2B:
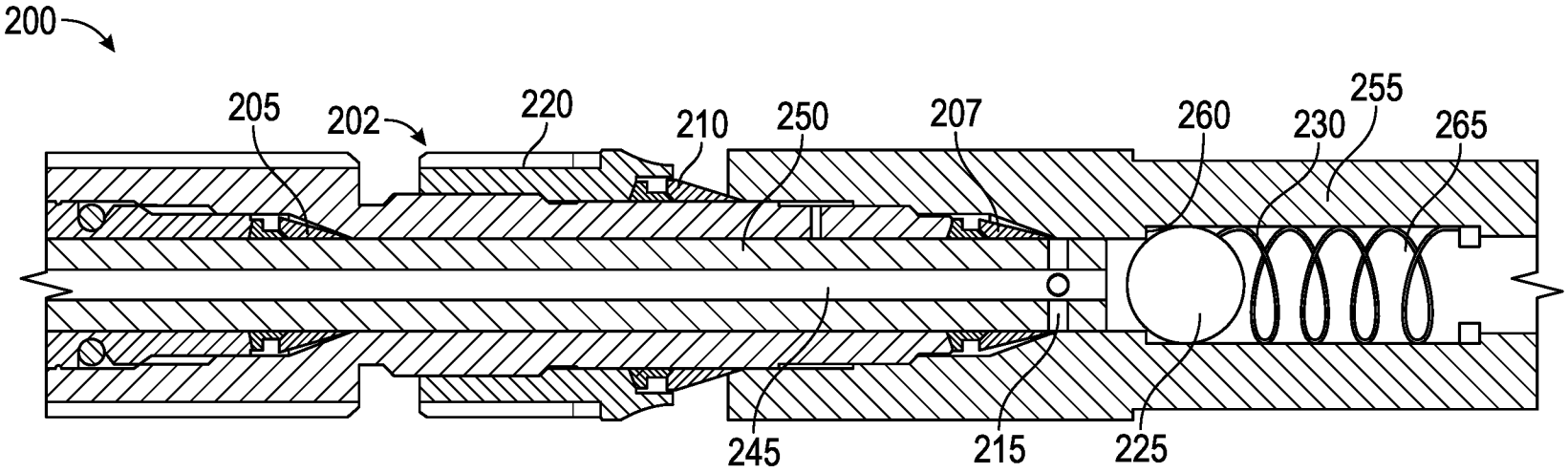
FIG. 2B is a cross-sectional view of an exemplary actuatable obstruction apparatus in an actuated configuration having a biasing member and an openable flowbore.

FIG. 2B is a cross-sectional view of the actuatable obstruction apparatus 200 in an actuated configuration. In this configuration, the retractable segment 250 has been retracted a distance from the inner bore 265. When abandoning the wellbore, the retractable segment 250 can be retracted fully out of the inner bore 265 and to the surface. The seal coupling device 202 may remain within the wellbore. When the retractable segment 250 is withdrawn the biasing member 230 urges the obstruction member 225 against the shoulder seat 260. When the obstruction member 225 is seated against the shoulder seat 260 it forms a seal thereby blocking the flow of fluid from within the inner bore 265. Accordingly, fluid cannot flow past the obstruction member 225 in the uphole direction thereby sealing the abandonable segment 255. Fluid is also unable to flow past the obstruction member 225 in the downhole direction if such pressure is less than the force applied by the strength of the biasing member 230. This seal of the obstruction member 225 seated in the shoulder seat 260 may form a metal-to-metal seal, when both components are metal.

Figure 3A:
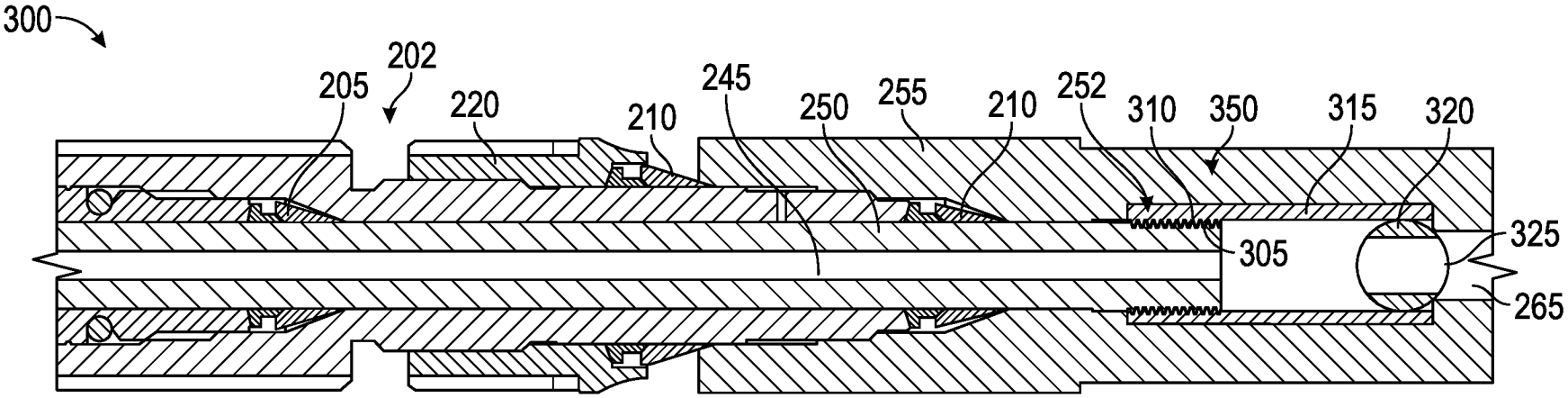
FIG. 3A is a cross-sectional view of an exemplary actuatable obstruction apparatus in an unactuated configuration having a rack gear.

FIG. 3A is a cross-sectional view of the actuatable obstruction apparatus 300 in an unactuated configuration. As illustrated, the seal coupling device 202 (described in FIGS. 2A-2B) may form a seal around retractable segment 250. The distal end 252 of the retractable segment 250 has a linear actuator 350 including gear teeth 305. The abandonable segment 255 has a rack gear 315 with opposing gear teeth 310. The inner bore 265 of the abandonable segment 255 has an obstruction member 320 coupled with the rack gear 315 and having a flow port 325. The inner bore 265 may have a smaller diameter than rack gear 315. In this unactuated configuration, the flow port is 325 is aligned open with the inner bore 265 so as to permit fluidic communication across the obstruction member 320. The obstruction member 320 may be spherical to facilitate rotation in the tubular shaped inner bore 265.

Figure 3B:
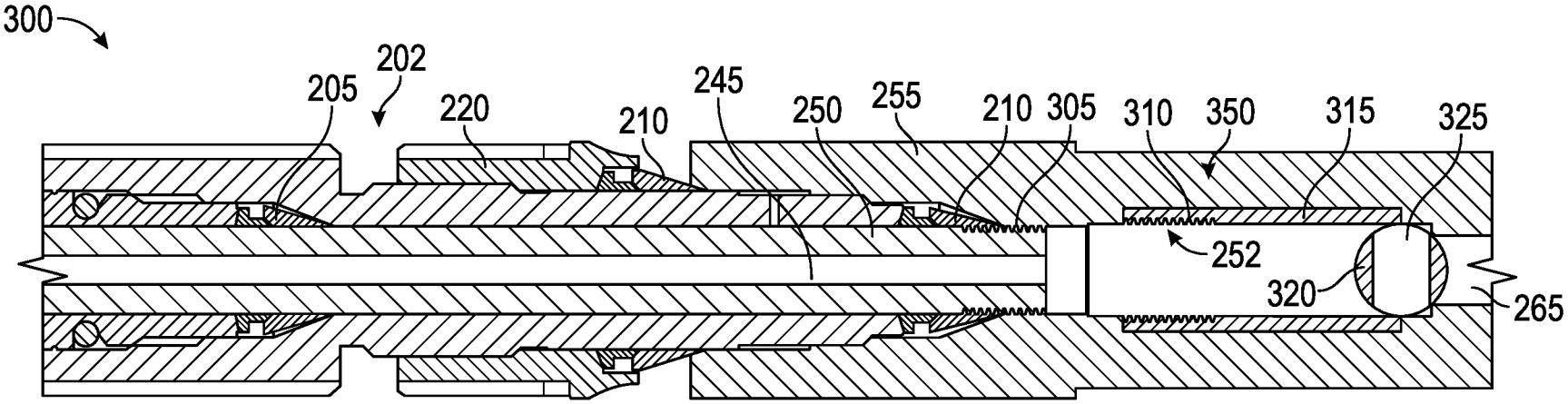
FIG. 3B is a cross-sectional view of an exemplary actuatable obstruction apparatus in an actuated configuration having a rack gear.

FIG. 3B is a cross-sectional view of the actuatable obstruction apparatus 300 in an actuated configuration. In this actuated configuration the retractable segment 250 has been withdrawn from the rack gear 315. As the retractable segment 250 is withdrawn, the gear teeth 305 resist the opposing gear teeth 310 shifting the rack gear 315 in the same uphole direction as retractable segment 250. As it is drawn uphole the rack gear 315 rotates the obstruction member 320 such that the flow port 325 is misaligned with the inner bore 265 thereby closing the flow port 325. Upon closure of the flow port 325 fluidic communication across the obstruction member 320 is prevented sealing the abandonable segment 255. Accordingly, the gear teeth 305 and rack gear 315 form a linear actuator for actuating and closing the obstruction member 320.

The retractable segment 250 and the abandonable segment 255 may be formed in the unactuated configuration illustrated in FIG. 2A. Alternatively, when deploying the tubular control conduit 130, the retractable segment 250 may be inserted into the abandonable segment 255, wherein the gear teeth 305 may interact with the opposing gear teeth 310 of the rack gear 315 shifting the obstruction member 320 from the actuated configuration to the unactuated configuration.

Figure 3C:
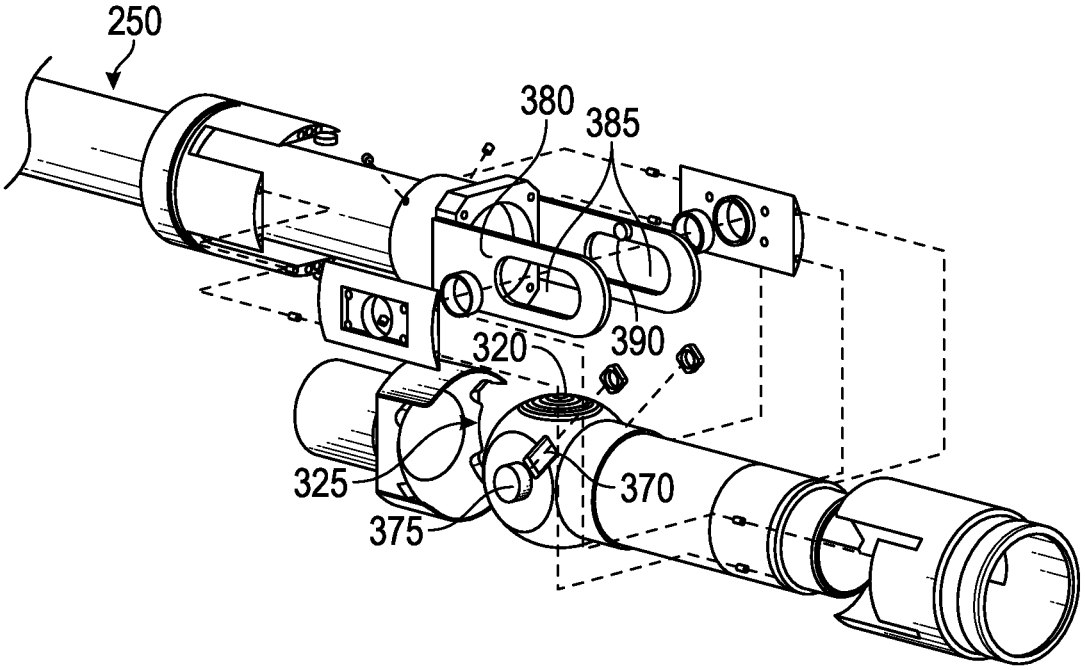
FIG. 3C is an exploded schematic diagram of an exemplary alternative actuatable obstruction apparatus having guide arms.

FIG. 3C is an exploded diagrammatic view of alternative arrangement for actuating an obstruction member 320. As illustrated, the obstruction member 320 may have a guide projection 375 and a notch 370. A guide arm 380 may have a guide slot 385. The guide slot 385 may receive the guide projection 375 and the notch 370 may receive the protrusion 390. In an unactuated configuration the retractable segment 250 the guide arm 380 is shifted downhole thereby moving the protrusion 390 in a downhole direction. Accordingly, in the unactuated configuration, the notch 370 may be in an open position permitting fluidic communication across the obstruction member 320.

When the retractable segment 250 is retracted, it pulls the guiding arm in the uphole direction thereby shifting the obstruction member to an actuated configuration. As a result, the flow port 325 is shifted to a closed position preventing fluidic communication across the obstruction member 320.

Figure 4A:
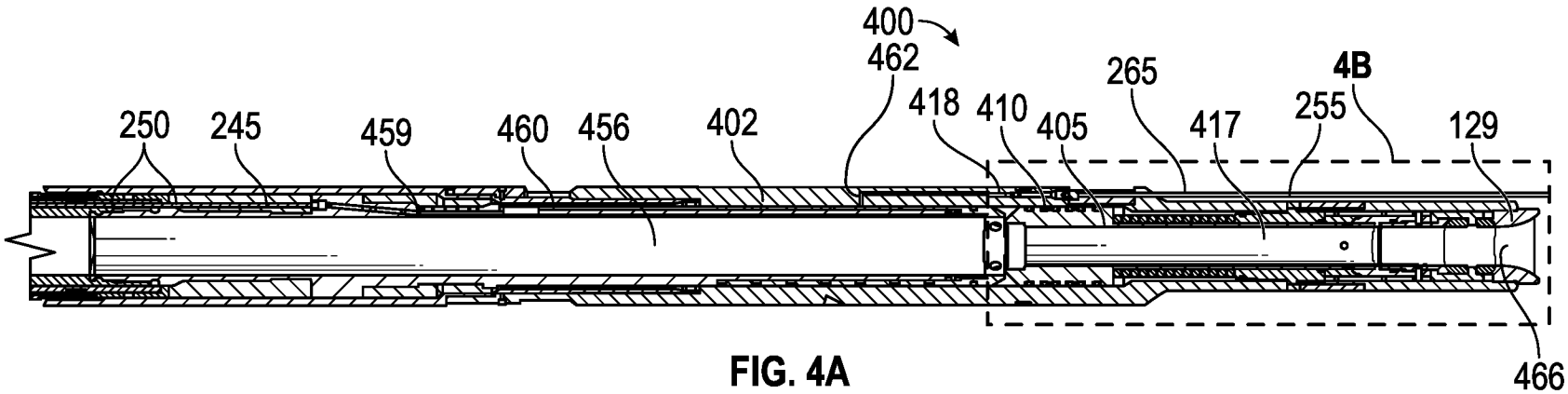
FIG. 4A is a cross-sectional view of an actuatable obstruction apparatus having a guide sleeve in an unactuated configuration.

FIG. 4A is a cross-sectional view of actuatable obstruction apparatus 400 in an unactuated configuration. As shown in FIG. 4A, the retractable segment 250 having inner bore 245 couples with a control channel 459 of retrievable tubular section 460. A tubular substructure 402 having flowbore 456 is engaged with the retrievable tubular section 460 having a cross-port 462 which couples the control channel 459 to the abandonable segment 255 having inner bore 265. The tubular substructure 402 includes a tubular control channel 418. Accordingly, the retractable segment 250 is fluidically or electrically coupled to the abandonable segment 255 via the cross-port 462 in the tubular substructure. This permits communication and flow of fluid from the inner bore 245 of the retractable segment 250 to the tubular control channel 418 of the tubular substructure 402 via the cross-port 462, and further within abandonable segment 255. The obstruction member 405 having a seal 410 is actuatable to block fluid flow from the cross-port 462. The obstruction member 405 has an inner bore 417 for flow of production fluid. The portion of FIG. 4A section 4B is enlarged for illustration in FIG. 4B.

Figure 4B:
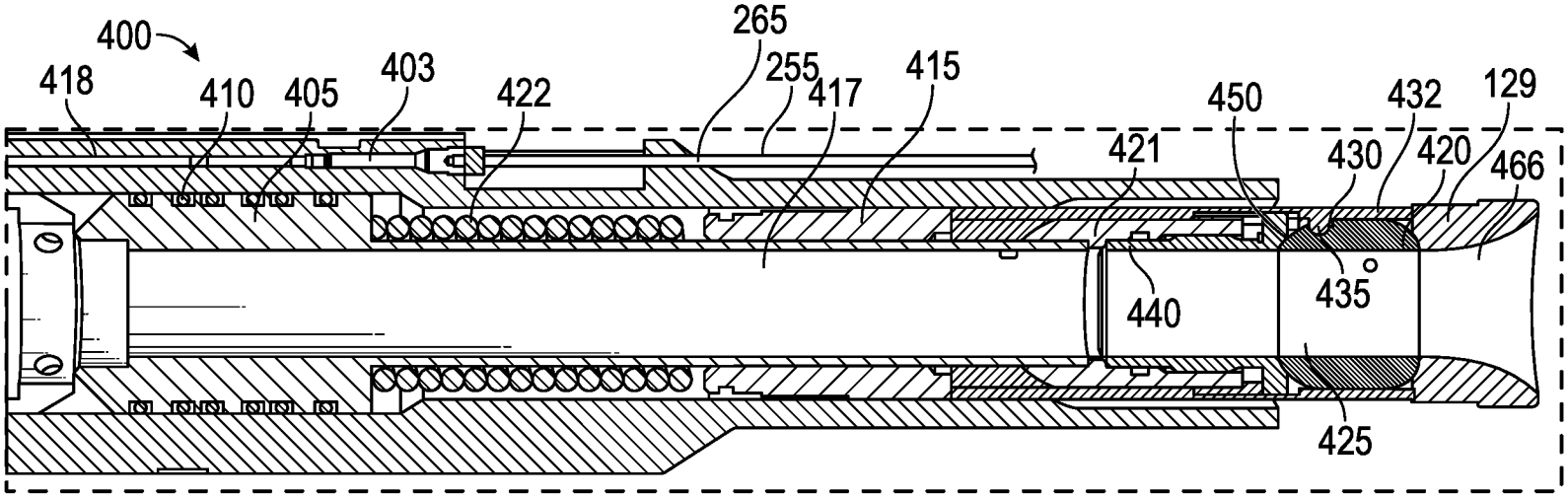
FIG. 4B is an enlarged cross-sectional view of an actuatable obstruction apparatus in an unactuated configuration having a guide sleeve.

FIG. 4B is an enlarged cross sectional diagram of an actuatable obstruction apparatus 400 in an unactuated configuration. As shown the tubular control channel 418 having inner bore 403 couples with the abandonable segment 255. The actuatable obstruction apparatus 400 includes an obstruction member 405 (which may be for instance, an isolation sleeve as shown) having a seal 410 around its outer perimeter and an inner bore 417. The obstruction member 405 passes through and is slideable within a middle sleeve 415 and is further coupled with a connecting sleeve 421. The tubing obstruction member 420 is positioned between the obstruction member 405 and the abandonable segment 129 which permits or blocks flow from the abandonable segment 129 to the obstruction member 405 depending on its configuration as part of the actuatable obstruction apparatus 400. In the unactuated configuration, the tubing obstruction member 420 is shown having a flow port 425 in an open position aligned with the inner bore 466 of abandonable segment 129 and inner bore 417 of the obstruction member 405, permitting fluidic communication across the tubing obstruction member 420. The tubing obstruction member 420 has a notch 430 in which a protrusion 435 extends from control arms 432. A seal 450 is formed between the tubing obstruction member 420 and the tubular seal segment 440.

Figure 4C:
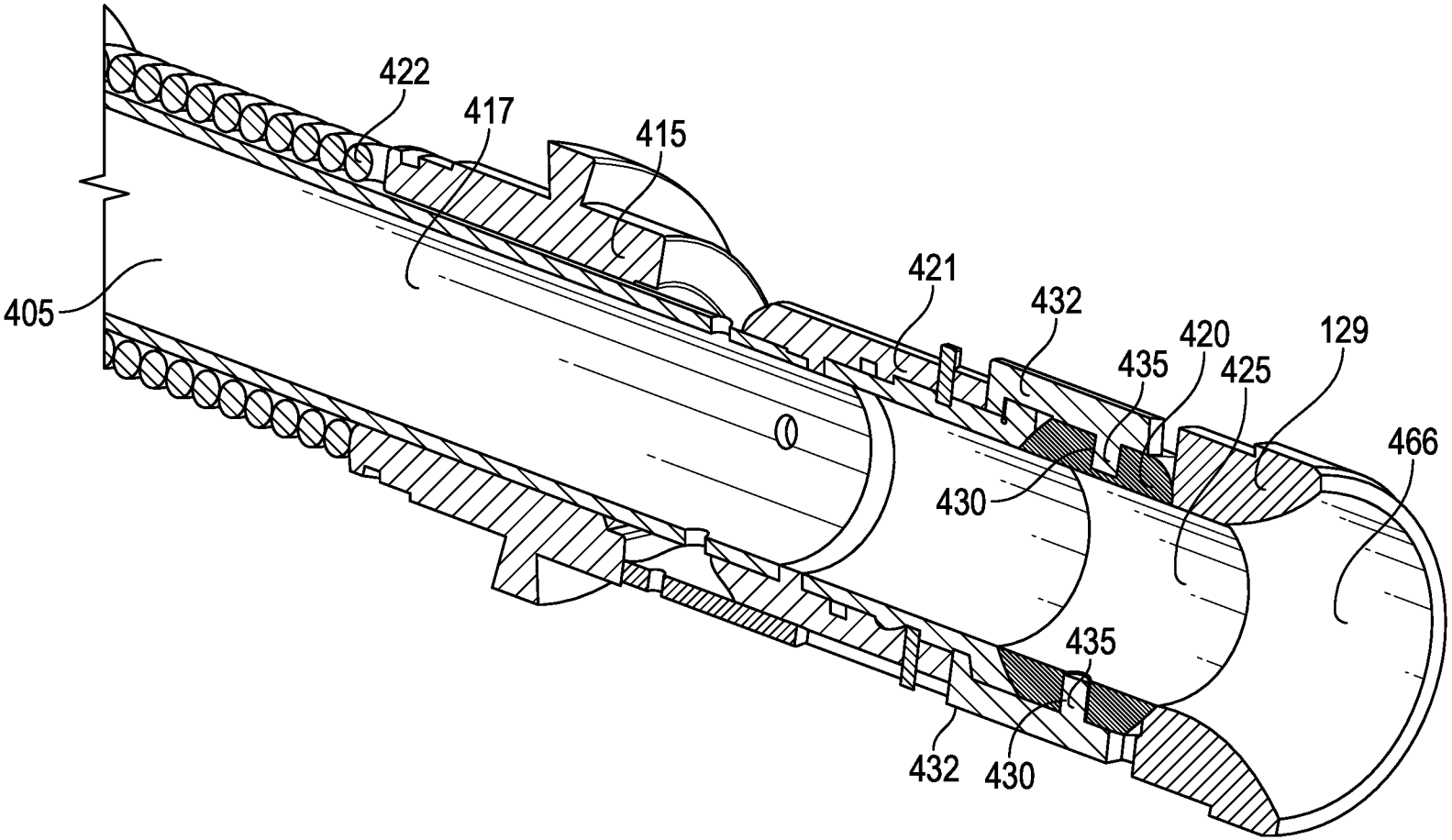
FIG. 4C is a perspective view of an actuatable obstruction apparatus in an unactuated configuration having a guide sleeve.

FIG. 4B also shows the obstruction member 405 held in the unactuated position by the retrievable section 460. When deploying the tubular control conduit 130, the retrievable section 460 (shown in FIG. 4A) may be inserted and urged against (directly or indirectly) the obstruction member 405. This has the effect moving the obstruction member 405 to the unactuated position, allowing the cross-port 462 in the tubular substructure 402 to align with and couple with the control channel 459 (via a port for instance) of the retrievable tubular section 460, ultimately connecting inner bore 245 and inner bore 265 of the retractable segment 250 and the abandonable segment 255 respectively. This also has the effect of compressing the biasing member 422, which may be a coiled spring, against the middle sleeve 415, and additionally shifting the control arms 432. Accordingly, via the protrusion 435 and notch 430, the tubing obstruction member 420 is rotated to the open position. FIG. 4C illustrates a perspective view of the actuatable obstruction apparatus 400 in the unactuated configuration. As can be seen more clearly, in the unactuated configuration, the flow port 425 is aligned with the inner bore 417 of the obstruction member 405 and inner bore 466 of the lower abandonable segment 129 so as to permit fluid flow across the tubing obstruction member 420.

Figure 4D:
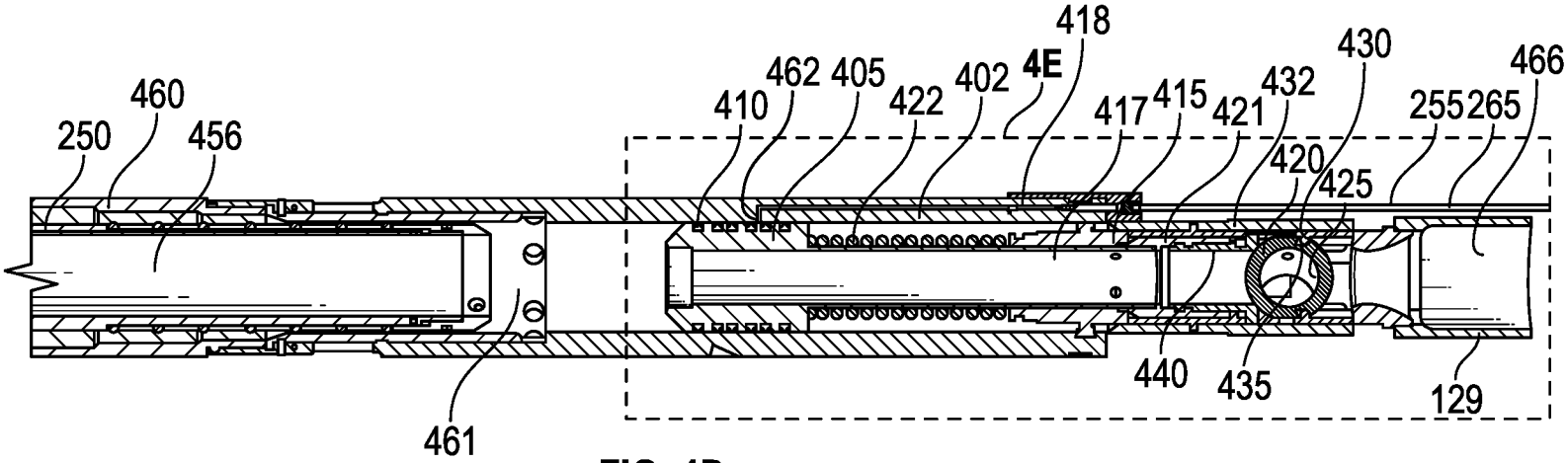
FIG. 4D is a cross-sectional view of an actuatable obstruction apparatus in an actuated configuration having a guide sleeve.

FIG. 4D is a cross-sectional view of the actuatable obstruction apparatus 400 in an actuated configuration. When abandoning the well, the retrievable section 460 is withdrawn thereby releasing the obstruction member 405. As shown the distal end 461 of the retrievable section 460 has been retracted away from the obstruction member 405. As a consequence, the obstruction member 405 is urged in the uphole direction by the biasing member 422. This causes the obstruction member 405 to moves to a position such that the seals 410 straddle the cross-port 462 in the tubular substructure 402, obstructing the fluidic communication path with the abandonable segment 255. This also shifts the connecting sleeve 421 along with control arms 432 in the uphole direction. As a result, due to the protrusion 435 within the notch 430, the tubing obstruction member 420 is actuated to the closed position.

Figure 4E:
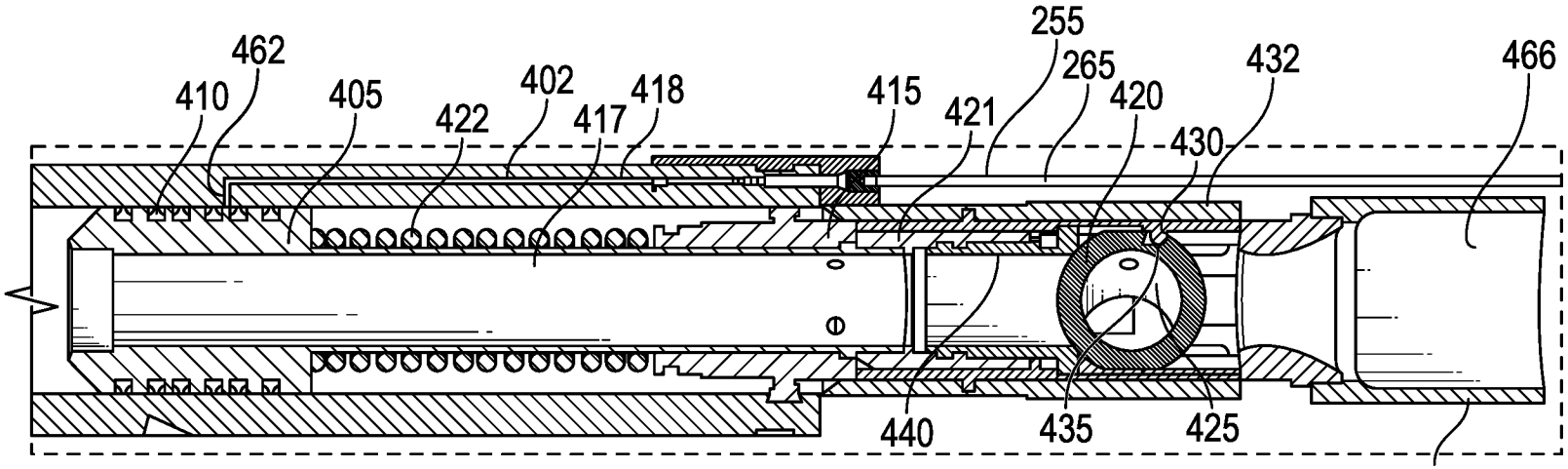
FIG. 4E is an enlarged cross-sectional view of actuatable obstruction in an un actuated configuration apparatus having a guide sleeve.

FIG. 4E is an enlarged cross-sectional view of an actuatable obstruction apparatus 400 in an actuated configuration. As shown, the tubing obstruction member 420 is actuated to the closed position. Due to the shifting of the obstruction member 405 in the uphole direction via the biasing member 422, the seal 410 is located to isolate cross-port 462 that was formerly in communication with the control channel 459 of the retrievable section 460.

Figure 4F:
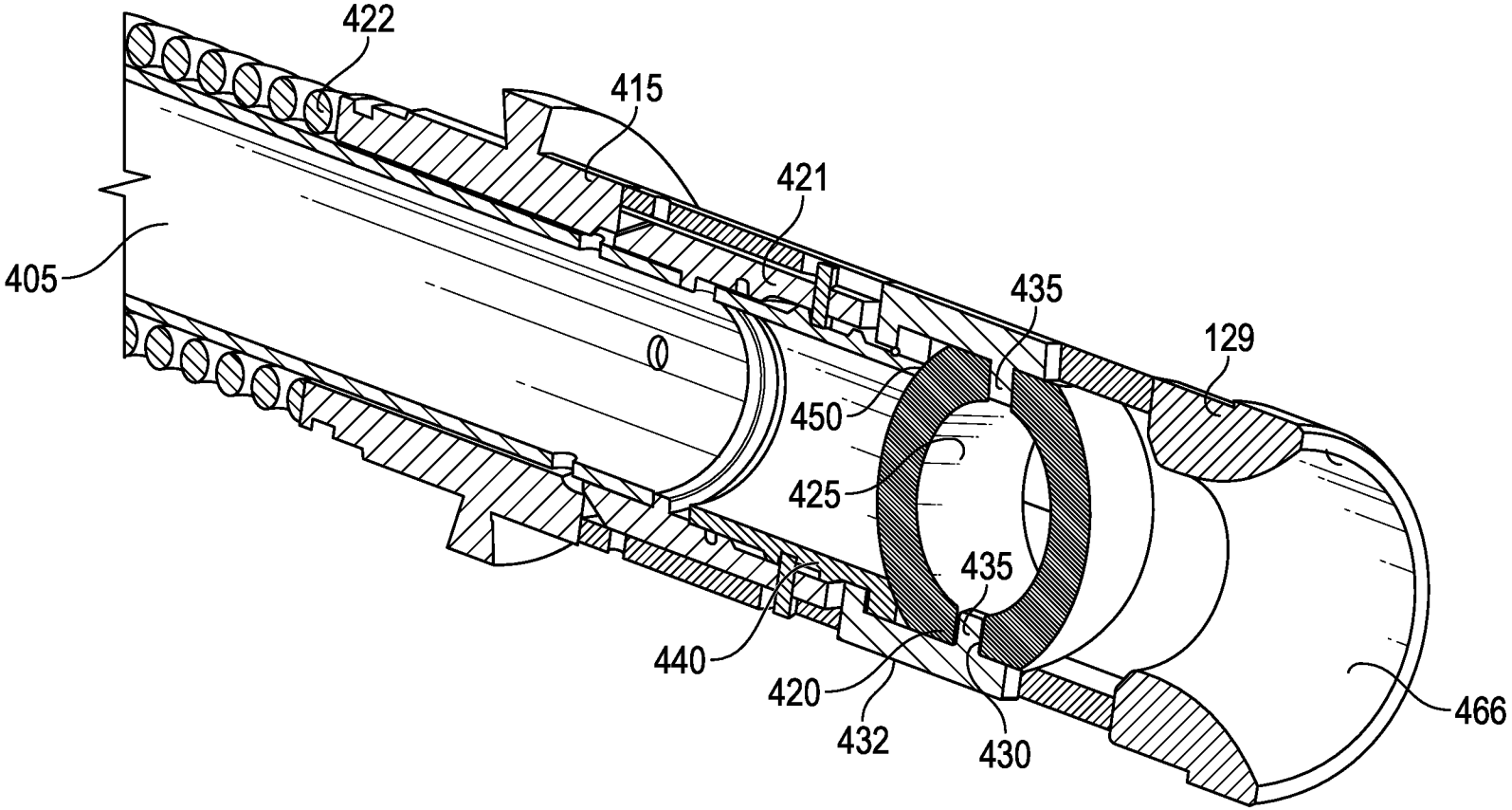
FIG. 4F is a perspective view of an actuatable obstruction apparatus in an actuated configuration having a guide sleeve.

FIG. 4F illustrates a perspective view of the actuatable obstruction apparatus 400 in the actuated configuration. As can be seen, the tubing obstruction member 420 forms a seal 450 with tubular seal segment 440. While seal 450 is illustrated, any sealing mechanism may be employed such as a flapper, or O-ring and may use other materials such as plastic or rubber, which may be appropriately adjusted or modified to withstand downhole temperature pressure.

Figure 4G:
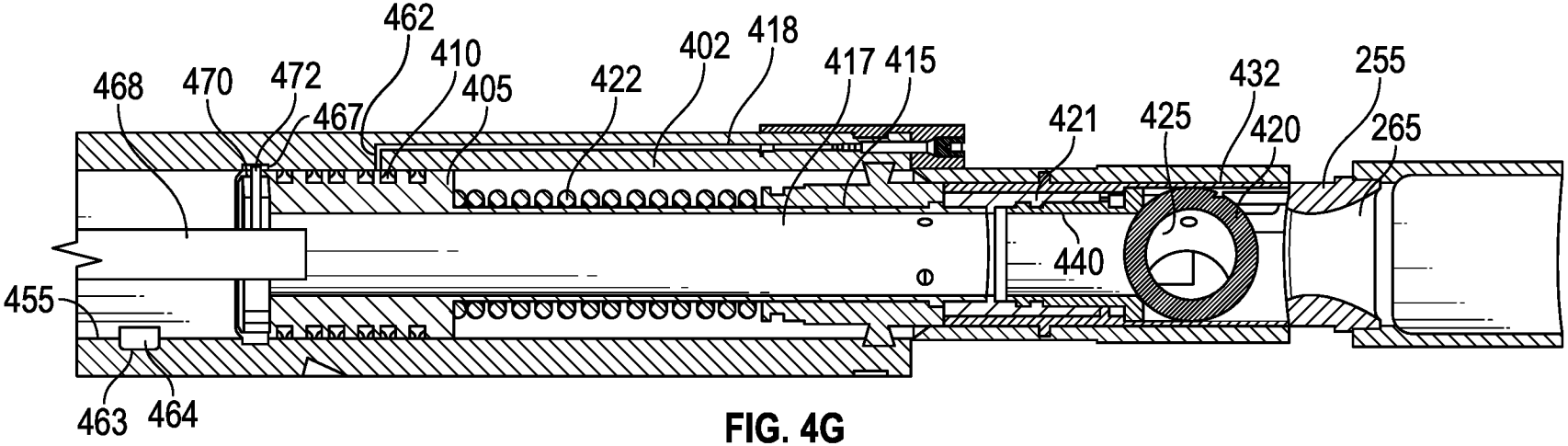
FIG. 4G is a cross-sectional view of an actuatable obstruction apparatus having a locking profile.

After retraction of the retractable segment 250 the obstruction member 405 may be locked in place. FIG. 4G is a cross-sectional view of the actuatable obstruction apparatus 400 in an actuated configuration further being locked in place. A locking profile 463 may be provided on the inner surface 455 of the tubular substructure 402. This locking profile 463 may be machined at the surface prior to deployment. A plunger 468 may be deployed to within the tubular substructure 402 so as to puncture an aperture 470 through the obstruction member 405. When inserting the plunger 468, it may have an extension 464 which may lock into the locking profile 463 so as to assist in locating the plunger 468 at the proper depth and position. The plunger 468 may puncture the obstruction member 405 with projection 467 through the aperture 470 to extend into a notch 472 in the tubular substructure 402. This has the effect of locking the obstruction member 405 in place. The locking of the obstruction member 405 may assist in preventing inadvertent compression of the biasing member 422 and opening of the tubing obstruction member 420 or uncovering cross-port 462, for instance when cement is thereafter poured in the wellbore 135 after actuation of the actuatable tubing obstruction apparatus 400.

Figure 5A:
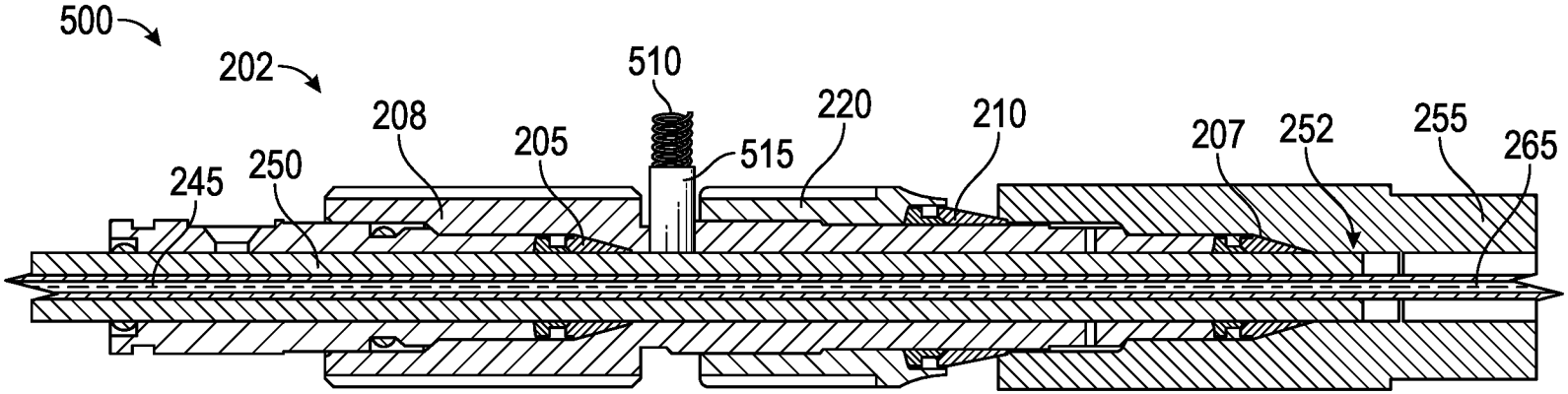
FIG. 5A is a cross-sectional view of an actuatable obstruction apparatus in an unactuated configuration having an obstruction member without a flowbore.

FIG. 5A is a cross-sectional view of actuatable obstruction apparatus 500 in an unactuated configuration. The actuatable obstruction apparatus 500 includes a modified seal coupling device 202. As illustrated the seal coupling device 202 is provided around the retractable segment 250. The seal coupling device 202 may have an inner seal 205 which seals around the retractable segment 250, and a middle seal 210, and a distal seal 207 for sealing the distal end 252 of the seal coupling device 202 with the retractable segment 250.

An obstruction member 515 may be provided extending through the body 208 of the seal coupling device 202 and laterally engaged with the retractable segment 250. A biasing member 510 is provided which urges the obstruction member 515 radially inward against the retractable segment 250.

Figure 5B:
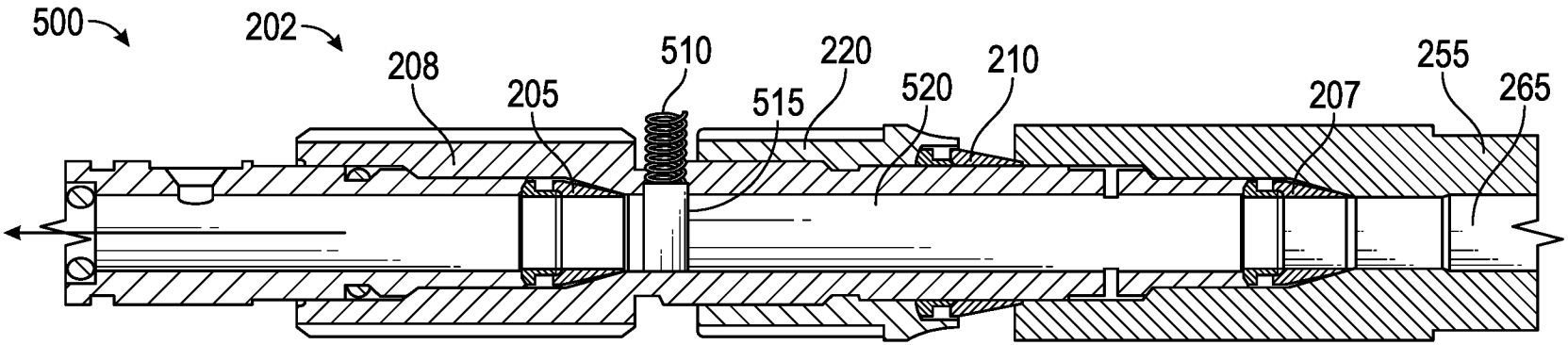
FIG. 5B is a cross-sectional view of an actuatable obstruction apparatus in an actuated configuration having an obstruction member without a flowbore.

FIG. 5B is a cross-sectional view of actuatable obstruction apparatus 500 in an actuated configuration. Upon retraction and withdrawal of the retractable segment 250, the obstruction member 515 is urged by the biasing member 510 within the inner bore 520 of the seal coupling device 202. The obstruction member 515 may be any shape such as rectangular, circular or oval, but is large enough to block the flow of fluid. Accordingly, upon retraction of the retractable segment 250, the obstruction member 515 is actuated and urged into inner bore 520 of the seal coupling device 202 prevent fluid communication across the obstruction member 515.

Figure 6A:
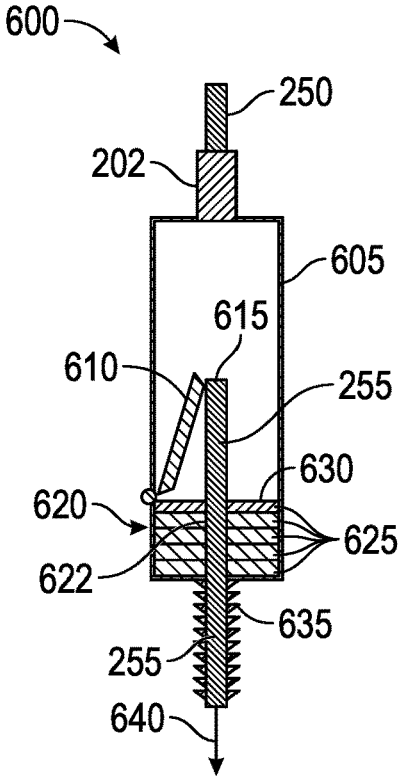
FIG. 6A is a cross-sectional view of an actuatable obstruction apparatus in an unactuated configuration having a chamber.

FIG. 6A is a cross-sectional view of an actuatable obstruction apparatus 600 in an unactuated configuration. As illustrated, actuatable obstruction apparatus 600 includes a chamber 605 having the retractable segment 250 coupled with and in fluidic communication with the chamber 605. The seal coupling device 202, which as mentioned above may be a ferrule type tubing connector, couples the retractable segment 250 to the chamber 605 to provide a seal. The chamber 605 may have larger inner diameter than either of the retractable segment 250 or the abandonable segment 255. The abandonable segment 255 in the unactuated configuration is inserted such that its mouth 615 is above a seal stack 620. The seal stack 620 has a plurality of seals 625 and may have a bore 622 running through the stack to the abandonable segment 255. The seals 625 may include a top metal seal 630 forming a seat for the obstruction member, which in the illustrated example is flapper valve 610 when it is lowered (shown in FIG. 6B). The remaining seals 625 may also be metal or other material such as rubber, plastic, or a composite, and able to withstand downhole temperatures and pressures.

The ratchet system 635 may be angled protrusions along the external surface of the abandonable segment 255 and into the seal stack 620, or composed of a split ring with a toothed profile clamping onto the abandonable segment 255.

In the unactuated configuration, the abandonable segment 255 also abuts and maintains or urges the flapper valve 610 in a raised unactuated configuration. This permits fluid communication between the retractable segment 250, the chamber 605 and the abandonable segment 255. Further, with the flapper valve 610 in the raised unactuated configuration fluid may be transmitted between the retractable segment 250 and the chamber 605. The chamber 605 may be drawn upward thereby causing the abandonable segment 255 to move in the direction of the arrow 640 relative the chamber 605.

Figure 6B:
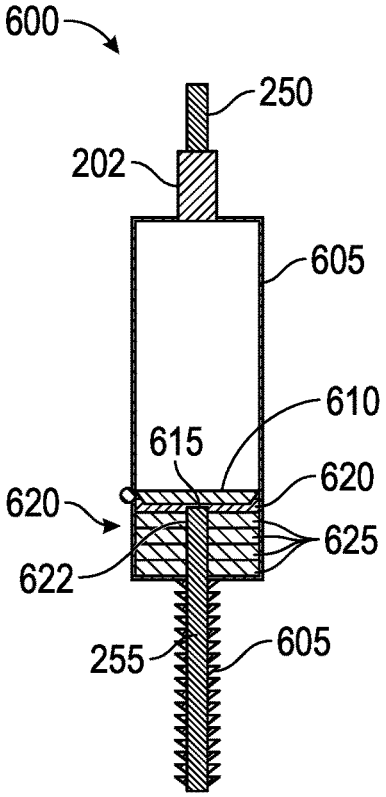
FIG. 6B is a cross-sectional view of an actuatable obstruction apparatus in an actuated configuration having a chamber.

FIG. 6B is a cross-sectional view of an actuatable obstruction apparatus 600 in an actuated configuration. The actuatable obstruction apparatus 600 may be actuated by retracting the retractable segment 250. As the retractable segment 250 is pulled up, this raises the chamber 605 with respect to the abandonable segment 255, causing the abandonable segment 255 to move in the direction of the arrow 640 relative the chamber 605. As mouth 615 of the abandonable segment 255 is drawn down to within the seal stack 620, the flapper valve 610 closes and seals off the chamber 605 from the mouth 615 and abandonable segment 255. The mouth 615 may be drawn to just within the metal seal 630, to form a metal-to-metal seal (as the abandonable segment 255 is metal). Furthermore, the flapper valve 610 may be metal, thereby forming a seal between the flapper valve 610 and the top metal seal 630.

As the mouth 615 is drawn below the abandonable segment 255 is shifted to the protrusions of the ratchet system 635 are drawn below the chamber 605. The angled protrusions of the ratchet system 635 accordingly inhibit and/or prevent the chamber 605 from being pushed downward relative the abandonable segment 255 to the unactuated configuration. Therefore, if there is any downward pressure on the chamber 605 via fluid or cement or other downhole item, the ratchet system 635 assists in maintaining the actuatable obstruction apparatus 600 in the actuated configuration.

Figure 7A:
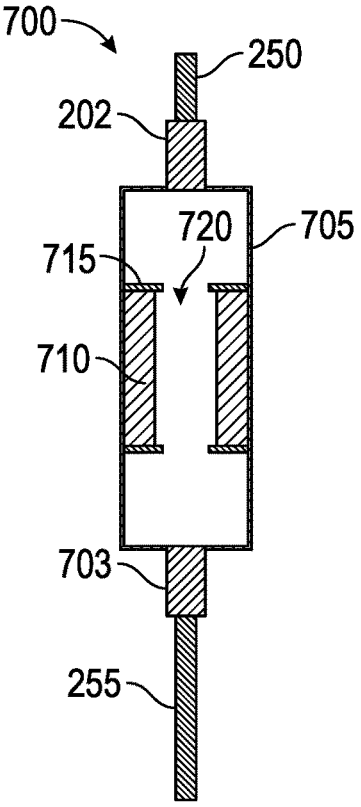
FIG. 7A is a cross-sectional view of an actuatable obstruction apparatus in an unactuated configuration having a swellable obstruction member.

FIG. 7A is a cross-sectional view of an actuatable obstruction apparatus 700 in an unactuated configuration. As illustrated, actuatable obstruction apparatus 700 includes a chamber 705 having the retractable segment 250 in fluidic communication with the chamber 705. The retractable segment 250 has the seal coupling device 202 providing a fluidically sealed connection to the chamber 705. Similarly, the abandonable segment 255 has a seal coupling device 703 on the downhole side of the chamber 705 providing sealed fluidic communication with the chamber 705. The chamber has an obstruction member, which in the illustrated embodiment is swellable obstruction member 710, which may be supported in a carrier 715. In the unactuated configuration in FIG. 7A, the swellable obstruction member 710 is not yet swelled, and accordingly orifice 720 is present thereby providing fluidic communication between the retractable segment 250 and the abandonable segment 255.

Figure 7B:
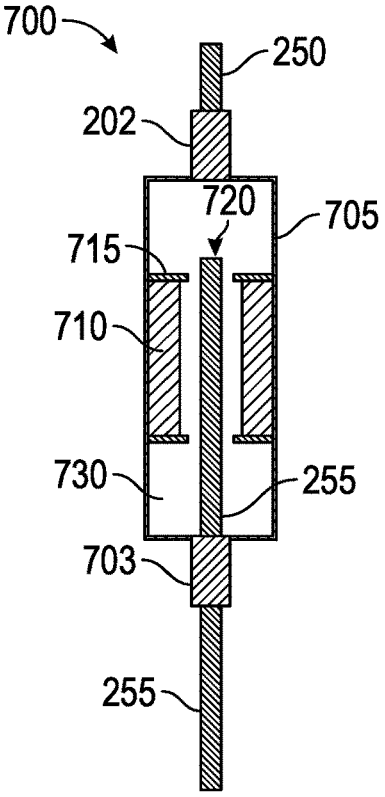
FIG. 7B is a cross-sectional view of an actuatable obstruction apparatus in an unactuated configuration having a swellable obstruction member.

FIG. 7B is a cross sectional view of an actuatable obstruction apparatus 700 with abandonable section 255 (this could also be the retractable segment 250, which will behave in the same manner) protruding past the swellable obstruction member 710 such that exposure of the swellable obstruction member 710 to the fluid in the actuatable obstruction apparatus 700 is prevented. When the actuatable obstruction apparatus 700 is pulled upward by retractable segment 250, the abandonable segment 255 is pulled from the swellable obstruction member 710, allowing fluid contact between the fluid in the actuatable obstruction apparatus 700 and the swellable obstruction member, allowing the fluid to activate the swelling process as shown in FIG. 7C.

Figure 7C:
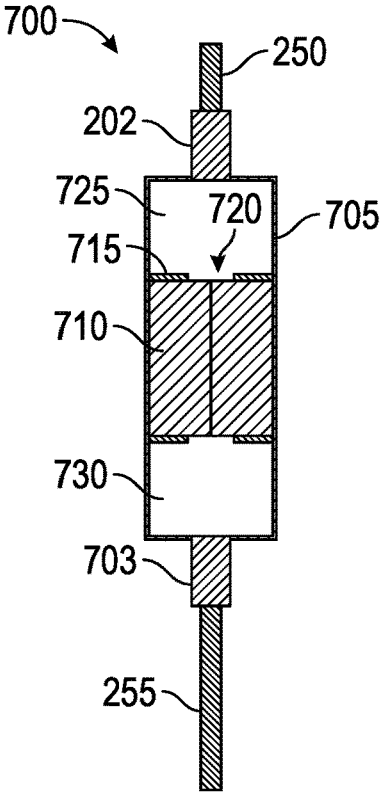
FIG. 7C is a cross-sectional view of an actuatable obstruction apparatus in an actuated configuration having a swellable obstruction member.

FIG. 7C is a cross-sectional view of an actuatable obstruction apparatus 700 in an actuated configuration. The swellable obstruction member 710 shown in FIG. 7A or 7B may be actuated to swell upon contact with water or alternatively with oil resulting in the actuated configuration of FIG. 7C. For instance, if the fluid in tubular control conduit 130 used for providing control signals is oil based, then the swellable obstruction member 710 may be swellable in the presence of an aqueous fluid. Alternatively, if the fluid in tubular control conduit 130 used for providing control signals is water based, then the swellable obstruction member 710 may be swellable in the presence of an oil based fluid. For convenience, a fluid which acts to swell the swellable obstruction member 710 may be referred to herein as an actuating fluid. When the abandonment phase is initiated, actuating fluid may be pumped from the surface through the retractable segment 250 to contact the swellable obstruction member 710. Alternatively, as shown in FIG. 7B, the abandonable section 255 may be pulled from within the swellable obstruction member 710, exposing the swellable obstruction member 710 to the control line fluid, causing the swellable obstruction member 710 to swell. In the event that the retractable segment 250 is used to protrude through the swellable obstruction member 710, exposure to wellbore fluids could be used to cause the swellable obstruction member 710 to swell and obstruct the pathway through the actuatable obstruction apparatus 700.

The swellable obstruction member 710 may be made of any swellable material, including a swellable elastomer, swellable metal or composite material. Such material may include super absorbent polymers, and may include hydrogels. Polymers which may swell in the presence of water and may be superabsorbent include polymers including polyacrylate, polyacrylamide, polyvinyl alcohol (PVA), or other materials.

As shown in FIG. 7C, upon contact of the swellable obstruction member 710 with an actuating fluid, the swellable obstruction member 710 expands and blocks the orifice 720 thereby cutting off and preventing flow of fluid between the upper portion 725 and lower portion 730 of the chamber 705. Accordingly, upon actuation, flow of fluid across the swellable obstruction member 710 and between the retractable segment 250 and abandonable segment 255 is prevented.

Figure 8A:
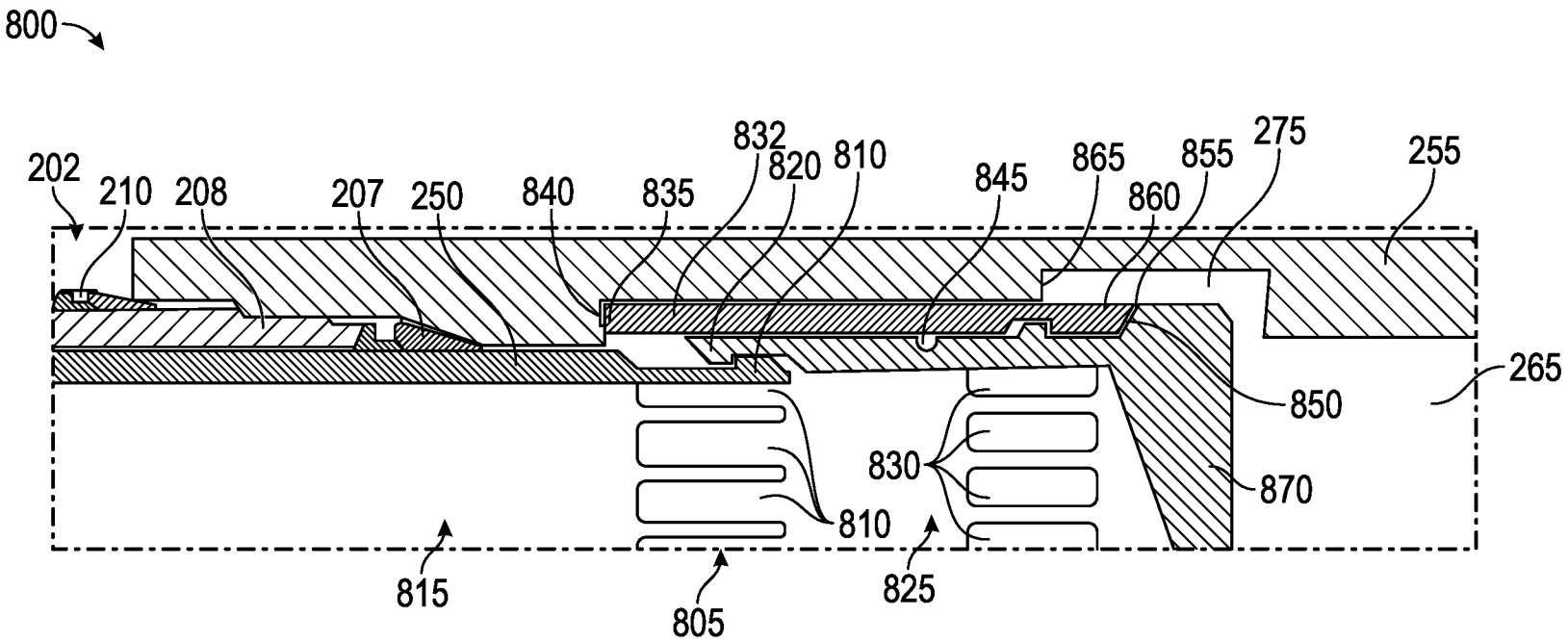
FIG. 8A is a cross-sectional view of an actuatable obstruction apparatus in an unactuated configuration having a deformable obstruction member.

FIG. 8A is a cross-sectional view of an actuatable obstruction apparatus 800 in an unactuated configuration. As illustrated the seal coupling device 202 is provided around the retractable segment 250 and inserted just within the end of abandonable segment 255. The retractable segment 250 in the embodiment of FIG. 8A has collet finger end 805 having a plurality of fingers 810, which when inserted downhole interlocks with opposing mandrel groove 820.

The mandrel 825 has a plurality of flow ports 830. Fluid may pass from the retractable segment 250 into the mandrel 825 and out of the flow ports 830. The abandonable segment 255 has a flowgap 275 radially external the plurality of flow ports 830 which permits fluid flow from the plurality of flow ports 830 to the inner bore 265 of the abandonable segment 255.

Positioned around the mandrel 825 is a deformable ferrule 832 which may be made of metal, plastic, rubber, or composite material. A sealing end 835 of the deformable ferrule 832 abuts a shoulder 840 of the abandonable segment 255, and forms a seal when actuated and compressed against the shoulder 840. Each component may be made of metal so as to form a metal-to-metal seal with the shoulder 840.

When the wellbore 135 is to be abandoned, the actuatable obstruction apparatus 800 is actuated by retracting the retractable segment 250. In particular, the retractable segment 250 is pulled uphole thereby placing it under tensile stress. Due to the interlocked collet fingers 810 and opposing mandrel groove 820, the mandrel 825 is correspondingly placed under tensile stress and urged uphole. The mandrel 825 may have a notch 845 which provides an integrated weakness at the place of the notch 845 in the mandrel 825, which severs at a predetermined tension. Additionally, the deformable ferrule 832 has a ramped rear 850 which is abutted by ramped shoulder 855 which form a seal, which when both are metal, is a metal-to-metal seal.

When the mandrel 825 is pulled and placed under sufficient tensile stress uphole (to the left in FIG. 8A), the mandrel 825 simultaneously moves uphole, and the deformable portion 860 of the deformable ferrule 832 is compressed by the ramped shoulder 855 and expanded into the upper shoulder 865 of the flowgap 275. Additionally, the obstruction end 870 of the mandrel 825 has no port or exit for the fluid, and is simply a solid piece (i.e., a zero inner diameter). The obstruction end 870 moves uphole along with the ramped shoulder 855 thereby preventing flow of fluid to the inner bore 265 of the abandonable segment 255. Additionally, the sealing end 835 of the deformable ferrule 832 is compressed against the shoulder 840 forming a seal. Accordingly, upon actuation, two seals may be formed, one at the place of the deformable portion 860 against the upper shoulder 865 and the other where the sealing end 835 is compressed against the shoulder 840.

Moreover, as the retractable segment 250 is still under tension from being drawn to the surface, the mandrel 825 will sever at the place of notch 845. The strength of the interlocked collet finger end 805 and opposing mandrel collet end 815 may be greater than the strength of the mandrel 825 at the place of the notch 845, so that the mandrel 825 breaks at the notch 845 rather than at either of the collet finger end 805 and opposing mandrel collet end 815. The size of the notch 845 may be adjusted so that the mandrel 825 severs at a predetermined tension. The retractable segment along with the collet finger end 805 and the opposing mandrel collet end 815 are then drawn to the surface.

Figure 8B:
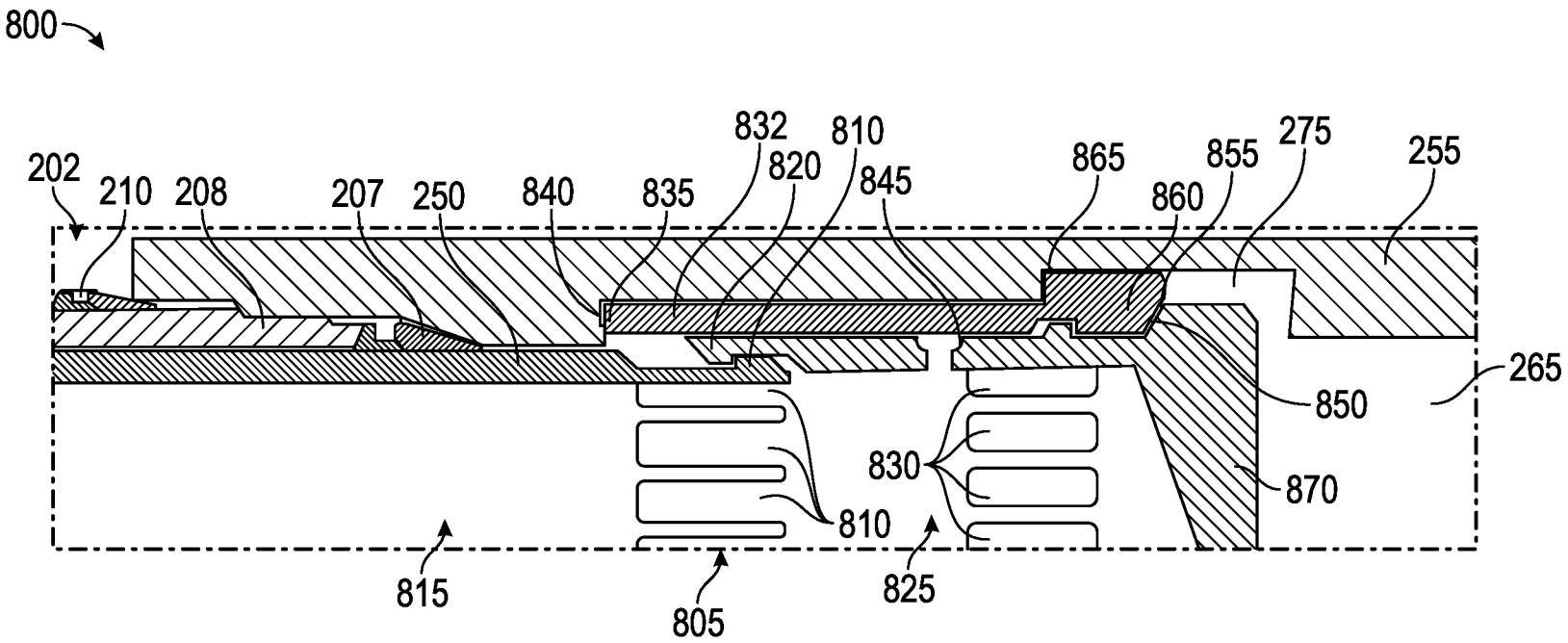
FIG. 8B is a cross-sectional view of an actuatable obstruction apparatus in an actuated configuration having a deformable obstruction member.

FIG. 8B is a cross-sectional view of an actuatable obstruction apparatus 800 in an actuated configuration. As illustrated, the deformable portion 860 of the deformable ferrule 832 has been pushed by the ramped shoulder 855 against the upper shoulder 865. A seal is formed by the contact of the deformable portion 860 against the upper shoulder 865, and between the deformable portion 860 and the ramped shoulder 855, which may be metal-to-metal seals. Accordingly, no fluid may pass beyond the obstruction end 870 of the mandrel 825 into or out of the abandonable segment 255. Moreover, as shown the mandrel 825 severed at the place of notch 845, and the collet finger end 805 and the opposing mandrel groove 820 are drawn toward the surface.

Figure 9A:
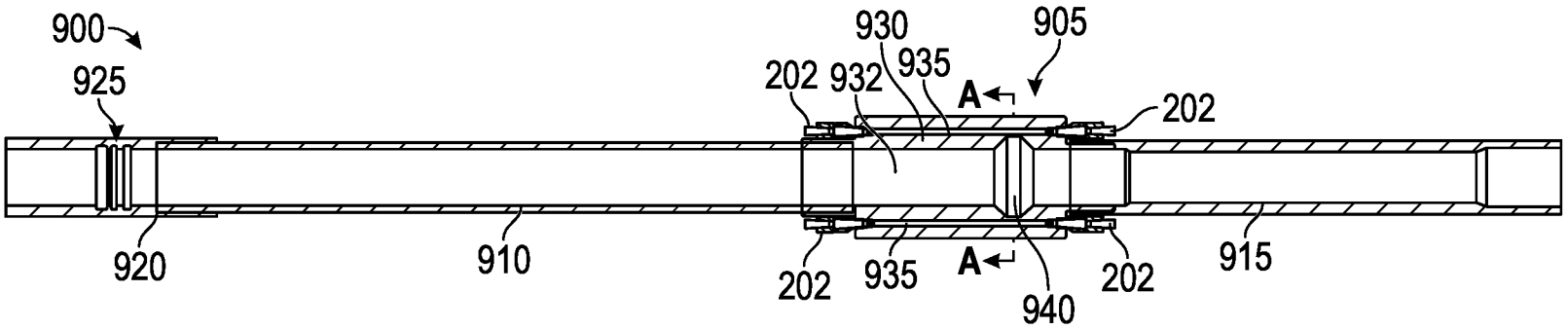
FIG. 9A is a cross-sectional view of an actuatable obstruction apparatus, in a plane parallel to the central axis, in an unactuated configuration having a control line communication assembly obstruction member.

FIG. 9A is a cross-sectional view of an actuatable obstruction apparatus 900 in an unactuated configuration. The actuatable obstruction apparatus 900 includes a control line communication assembly 905 coupled with a pup joint 910 positioned uphole from control line communication assembly 905 and a sealbore 915 downhole from the control line communication assembly 905. The pup joint 910 may be coupled with a landing nipple 920 having a locking profile 925 (or locating profile).

The control line communication assembly 905 has a tubular body 930 and an inner bore 932. Additionally, provided is a plurality of channels 935 extending longitudinally along the control line communication assembly 905. At the end of each of the plurality of channels 935 may be a seal coupling device 202. The seal coupling devices 202 may sealingly couple with tubular control conduits 130 (shown in FIG. 1). The control line communication assembly 905 has a recessed portion 940. The recessed portion 940 provides a reduction in wall thickness between the inner bore and the control lines plurality of channels 935.

Figure 9C:
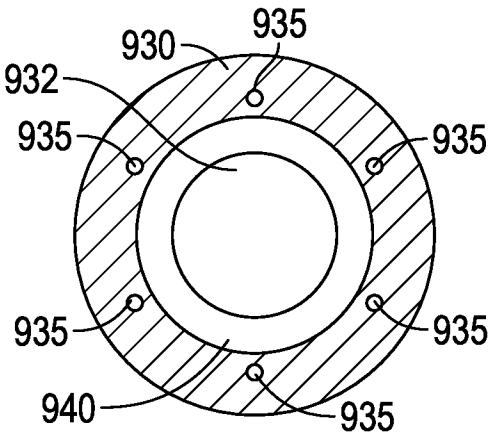
FIG. 9C is a cross-sectional view of a control line communication assembly, in a plane perpendicular to the central axis, in an unactuated configuration.
Figure 9B:
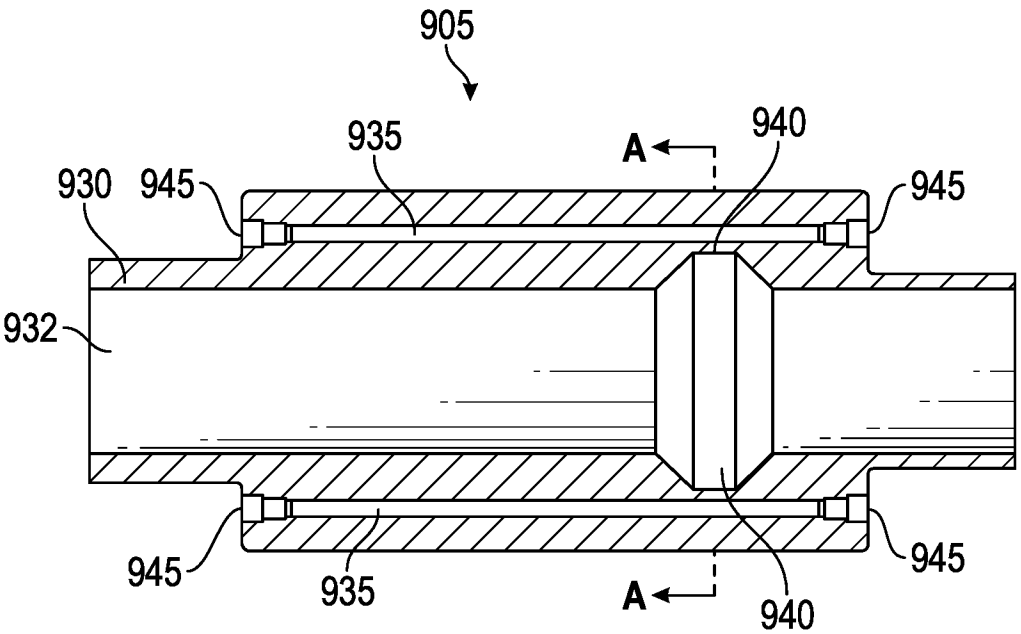
FIG. 9B is an enlarged cross-sectional view of the control line communication assembly of FIG. 9A, in a plane parallel to the central axis, in an unactuated configuration.

FIG. 9B is an enlarged cross-sectional view of the control line communication assembly 905 of FIG. 9A. FIG. 9B additionally illustrates seal connections 945 which may couple with the seal coupling devices 202. FIG. 9C is a cross-sectional view of the control line communication assembly 905 taken at section A of FIG. 9A and FIG. 9B. As shown in FIG. 9C is a plurality of channels 935, along with the inner bore 932 and tubular body 930. Although the plurality of channels 935 are shown with six channels in FIG. 9C, any number can be provided, including a single channel or more than six such as 10. Accordingly, the plurality of channels 935 may be, for instance, from two to 10, or alternatively from five to eight.

Figure 9D:
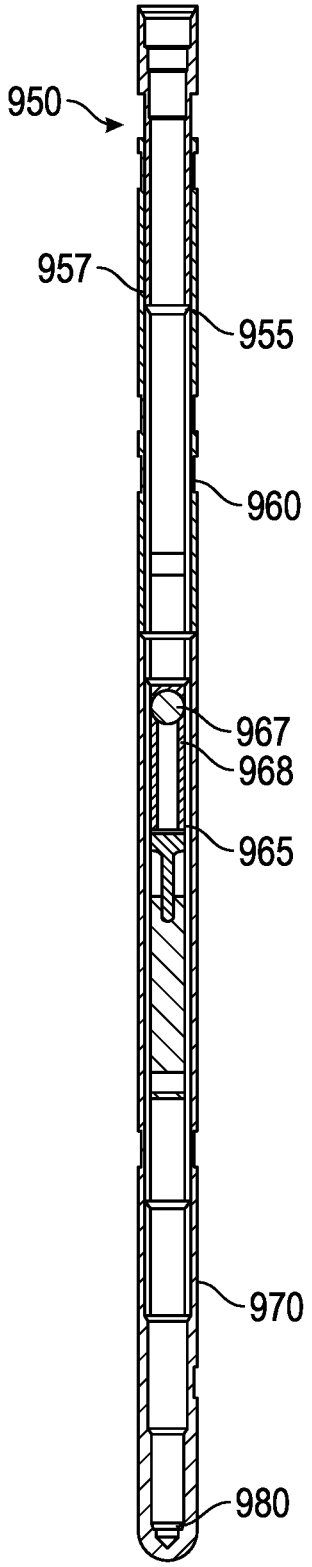
FIG. 9D is a cross-sectional view of an exemplary activating tool.

Pathways may be provided in the recessed portion 940 from the inner bore 932 to the plurality of channels 935 to inject resin or other solidifying agent which acts as an obstruction member. Such resin may be introduced via a tool which may puncture the walls of the inner bore 932. FIG. 9D is a cross-sectional view of a communication tool 950, which is part of the actuatable obstruction apparatus 900. The communication tool 950 includes several sections including a lock mandrel 955, a set element 960, a perforation assembly, seal assembly 970, and a bull nose 980.

In preparation for abandonment, the retractable segments 255 and the upper retractable segment 127 as discussed in FIG. 1B. The communication tool 950 may then be inserted via a conveyance, such as coiled tubing, downhole to the control line communication assembly 905. The bull nose 980 assists guiding the communication tool 950 through the wellbore. In order to position the communication tool 950 in the proper location, the locking mandrel 955 includes a locking portion 957 which interlocks with the locking profile 925. Upon locking the perforation assembly 965 aligns with the recessed portion 940. The perforation assembly 965 may be a gun assembly, blade or a chemical cutter, or other device which forms apertures in the recessed portion 940 to the plurality of channels 935.

Figure 9E:
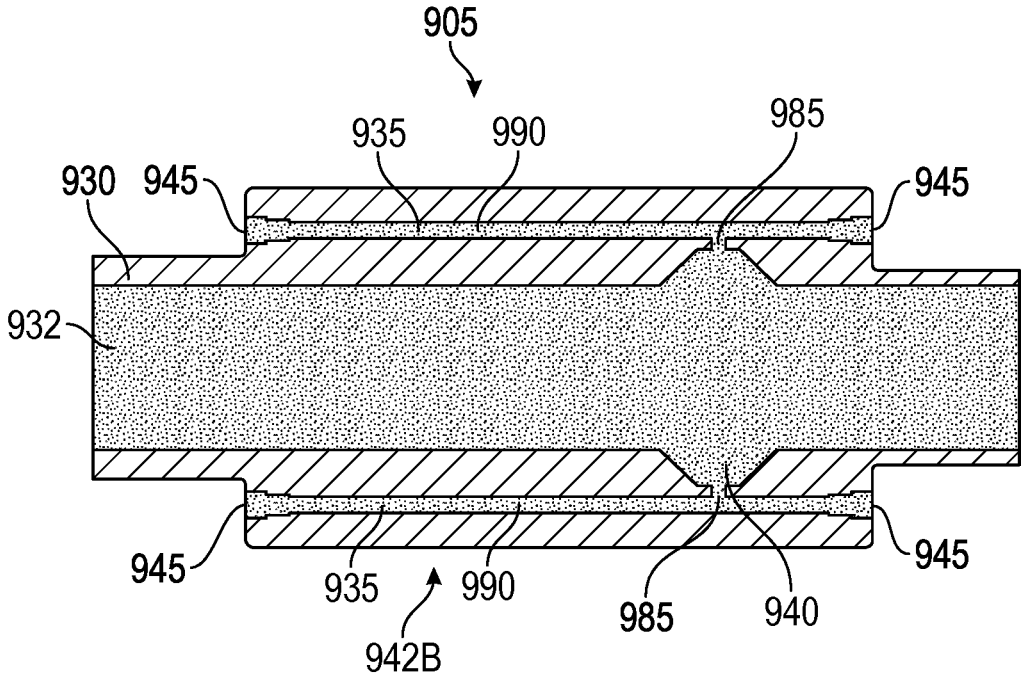
FIG. 9E is a cross-sectional view of a control line communication assembly, in a plane parallel to the central axis, in an actuated configuration.

The perforation assembly 965 may be actuated electrically, pneumatically, or by dropping an obturator 967, which may be a ball, dart, or other object, from the surface to be received in seat 968. Upon actuation, perforation assembly 965 actuates to form apertures, mechanically, such as punching into the wall of the inner bore 932, or chemically. FIG. 9E is a cross-sectional view of a control line communication assembly 905 after actuation of the perforation assembly 965. As illustrated, apertures 985 made in the recessed portion 940 from the inner bore 932 to each of the plurality of channels 935.

Once apertures are formed in the recessed portion 940, resin may be pumped from the surface or from within the communication tool 950 through the set element 960. The set element 960 (FIG. 9D) may be hydraulic, and employed to urge resin through the apertures 985. The seal assembly 970 prevents passage of the resin being pumped into the apertures 985. Accordingly, the hydraulic set element 960 together with the seal assembly 970 serve to isolate the resin and force it through the apertures 985. The set element 960 may be in communication with the surface which may be provided, electrically, hydraulically, wirelessly or otherwise to actuate the set element 960 and assist in urging the resin through apertures 985 into the plurality channels 935. As illustrated in FIG. 9E, resin 990 may reside in the plurality channels 935 and upon setting or cooling may serve as an obstruction member and a barrier for preventing fluid from within the tubular control conduits 130 which are coupled with the control line communication assembly 905 to prevent leak from the abandoned control tubular control conduits 130 abandonable segments 255.

Numerous examples are provided herein to enhance understanding of the present disclosure. A specific set of statements are provided as follows.

Statement 1: A method comprising: retracting a retractable segment of a tubular control conduit disposed in a wellbore leaving an abandoned segment of the tubular control conduit, each of the retractable segment and the abandoned segment having an inner bore; and actuating an obstruction member, the obstruction member forming a seal and preventing a flow of fluid past the obstruction member out from the inner bore of the abandoned segment upon actuation.

Statement 2: The method of Statement 1, further comprising introducing cement into the wellbore thereby covering the abandoned segment of the tubular control conduit.

Statement 3: The method of Statement 1 or 2, wherein actuating the obstruction member is initiated by the retracting the retractable segment.

Statement 4: The method of any one of the preceding Statements 1-3, further comprising transmitting, prior to retracting the tubular control conduit, communication signals via the tubular control conduit.

Statement 5: The method of any one of the preceding Statements 1-4, wherein the obstruction member has a substantially spherical shape.

Statement 6: The method of any one of the preceding Statements 1-5, wherein the inner bore of the abandoned segment comprises a shoulder seat receiving the obstruction member upon actuation, the obstruction member forming a seal when seated on the shoulder seat.

Statement 7: The method of any one of the preceding Statements 1-6, wherein the obstruction member comprises a flowbore, wherein prior to actuation the flowbore is open to the inner bore of the tubular control conduit, and subsequent actuation the flowbore is closed to the inner bore of the tubular control conduit.

Statement 8: The method of any one of the preceding Statements 1-7, wherein actuating comprises rotating the obstruction member.

Statement 9: The method of any one of the preceding Statements 1-8, wherein the obstruction member is rotated via a rack gear in the abandonable segment and opposing teeth on the retractable segment.

Statement 10: The method of any one of the preceding Statements 1-9, wherein actuating comprises urging the obstruction member into the inner bore of the abandoned segment via a biasing member and preventing fluid from the flow of fluid past the obstruction member.

Statement 11: The method of any one of the preceding Statements 1-10, wherein the obstruction member is has a deformable portion, and wherein actuating comprises deforming against a surface of the inner bore of the abandoned segment thereby preventing the flow of fluid.

Statement 12: The method of any one of the preceding Statements 1-11, wherein the abandoned segment comprises a chamber in fluidic communication with the inner bore, a flapper valve contained within the chamber, and wherein actuating the obstruction member comprises pivoting the flapper valve to block fluidic communication with the inner bore thereby forming a seal.

Statement 13: The method of any one of the preceding Statements 1-12, wherein the abandoned segment comprises a chamber in fluidic communication with the inner bore, the chamber having a swellable material, and actuating the obstruction member comprises contacting the swellable material with an actuating fluid thereby swelling the swellable material.

Statement 14: The method of any one of the preceding Statements 1-13, wherein contacting the swellable material is initiated through movement of the retractable segment.

Statement 15: The method of any one of the preceding Statements 1-14, wherein the obstruction member comprises a sliding sleeve, wherein upon actuation the sliding sleeve moves to a position obstructing flow from the inner bore of the abandoned segment.

Statement 16: The method of any one of the preceding Statements 1-15, wherein the obstruction member is solidifying agent.

Statement 17: The method of Statement 1-16, wherein actuating the obstruction member comprises forming apertures in a channel coupled with the tubular control conduit and injecting a solidifying agent.

Statement 18: A system comprising: a retractable segment and an abandoned segment of a tubular control conduit disposed in a wellbore, each of the retractable segment and the abandoned segment having an inner bore; and an obstruction member actuatable to form a seal and prevent a flow of fluid past the obstruction member in the inner bore of the abandoned segment upon actuation.

Statement 19: The system of Statement 18, wherein actuating the obstruction member is initiated by retracting the retractable segment of the tubular control conduit.

Statement 20: The system of Statement 18 or 19, wherein actuating comprises rotating the obstruction member.

Statement 21: The system of any one of the preceding Statements 18-20, wherein the actuatable obstruction member has been actuated, and cement has been introduced into the wellbore covering the abandoned segment.

Statement 22: The system of any one of the preceding Statements 18-21, wherein communication signals are transmitted via the tubular control conduit prior to actuation of the actuatable obstruction member.

Statement 23: An apparatus comprising: a tubular control conduit having a retractable segment and an abandoned segment, each of the retractable segment and the abandoned segment having an inner bore; and an obstruction member, the obstruction member actuatable upon retraction of the retractable segment to obstruct flow of fluid past the obstruction member out from the inner bore of the abandoned segment.

Statement 24: The apparatus of Statement 23, wherein the tubular control conduit is configured to transmit fluidic or electronic control signals at least prior to retraction of the retractable segment.

Statement 25: The apparatus of Statement 23 or 24, wherein the obstruction member has a substantially spherical shape.

Statement 26: The apparatus of any one of the preceding Statements 23-25, wherein the obstruction member comprises a sliding sleeve which moves upon retraction of the retractable segment to an actuated configuration wherein fluid flow is prevented past the obstruction member out from the inner bore of the abandoned segment.

Statement 27: The apparatus of any one of the preceding Statements 23-26, wherein the obstruction member is rotated via a rack upon retraction of the retractable segment.

Statement 28: The apparatus of any one of the preceding Statements 23-27, wherein the abandoned segment comprises a chamber in fluidic communication with the inner bore, the chamber having a swellable material, and actuating the obstruction member comprises contacting the swellable material with an actuating fluid thereby swelling the swellable material.

Statement 29: The apparatus of any one of the preceding Statements 23-28, wherein the obstruction member comprises a sliding sleeve, and upon actuation the sliding sleeve moves to a position obstructing fluid flow from the inner bore of the abandoned segment.

Statement 30: The apparatus of any one of the preceding Statements 23-29, wherein the obstruction member is solidifying agent, and wherein actuating the obstruction member comprises forming apertures in a channel coupled with the tubular control conduit and injecting a solidifying agent.

What is claimed is:

1. A method comprising:

retracting a retractable segment of a tubular control conduit disposed in a wellbore leaving an abandoned segment of the tubular control conduit, each of the retractable segment and the abandoned segment having an inner bore, and the abandoned segment comprises a chamber in fluidic communication with the inner bore and the chamber comprises a swellable material;

actuating an obstruction member comprising a swellable material by contacting the swellable material with an actuating fluid thereby swelling the swellable material, the obstruction member forming a seal and preventing a flow of fluid past the obstruction member out from the inner bore of the abandoned segment upon actuation;

introducing cement into the wellbore after retracting the retractable segment of the tubular control conduit to cover the abandoned segment of the tubular control conduit.

2. The method of claim 1, wherein actuating the obstruction member is initiated by the retracting the retractable segment.

3. The method of claim 1, further comprising transmitting, prior to retracting the tubular control conduit, communication signals via the tubular control conduit.

4. The method of claim 1, wherein contacting the swellable material is initiated through movement of the retractable segment.

5. A system comprising:

a retractable segment and an abandoned segment of a tubular control conduit disposed in a wellbore, each of the retractable segment and the abandoned segment having an inner bore, and the abandoned segment comprises a chamber in fluidic communication with the inner bore and the chamber comprises a swellable material; and an obstruction member comprising the swellable material, wherein the obstruction member is actuatable to form a seal by contacting the swellable material with an actuating fluid thereby swelling the swellable material and, upon actuation, prevent a flow of fluid past the obstruction member in the inner bore of the abandoned segment when cement is introduced into the wellbore after retracting the retractable segment of the tubular control conduit to cover the abandoned segment of the tubular control conduit.

6. The system of claim 5, wherein actuating the obstruction member is initiated by retracting the retractable segment of the tubular control conduit.

7. The system of claim 5, wherein the actuatable obstruction member has been actuated, and cement has been introduced into the wellbore covering the abandoned segment.

8. The system of claim 5, wherein communication signals are transmitted via the tubular control conduit prior to actuation of the actuatable obstruction member.

9. The system of claim 5, wherein contacting the swellable material is initiated through movement of the retractable segment.

10. An apparatus comprising:

a tubular control conduit having a retractable segment and an abandoned segment, each of the retractable segment and the abandoned segment having an inner bore; and an obstruction member, the obstruction member actuatable upon retraction of the retractable segment to obstruct flow of fluid past the obstruction member out from the inner bore of the abandoned segment when cement is introduced into the wellbore after retracting the retractable segment of the tubular control conduit to cover the abandoned segment of the tubular control conduit, wherein the obstruction member comprises a sliding sleeve, and upon actuation the sliding sleeve moves to a position obstructing fluid flow from the inner bore of the abandoned segment.

11. The apparatus of claim 10 wherein the tubular control conduit is configured to transmit fluidic or electronic control signals at least prior to retraction of the retractable segment.

12. The apparatus of claim 10, wherein the sliding sleeve which moves upon retraction of the retractable segment to an actuated configuration wherein the fluid flow is prevented past the obstruction member out from the inner bore of the abandoned segment.

13. A method comprising:

retracting a retractable segment of a tubular control conduit disposed in a wellbore leaving an abandoned segment of the tubular control conduit, each of the retractable segment and the abandoned segment having an inner bore;

actuating an obstruction member comprising a sliding sleeve, wherein upon actuation the sliding sleeve moves to a position obstructing flow from the inner bore of the abandoned segment such that the obstruction member forms a seal and prevents a flow of fluid past the obstruction member out from the inner bore of the abandoned segment upon actuation; and introducing cement into the wellbore after retracting the retractable segment of the tubular control conduit to cover the abandoned segment of the tubular control conduit.

14. The method of claim 13, wherein actuating the obstruction member is initiated by the retracting the retractable segment.

15. The method of claim 13, further comprising transmitting, prior to retracting the tubular control conduit, communication signals via the tubular control conduit.

16. A method comprising:

retracting a retractable segment of a tubular control conduit disposed in a wellbore leaving an abandoned segment of the tubular control conduit, each of the retractable segment and the abandoned segment having an inner bore and the abandoned segment comprising a chamber in fluid communication with the inner bore and the chamber containing a flapper valve;

actuating an obstruction member by pivoting the flapper valve to block fluidic communication with the inner bore thereby forming a seal; and introducing cement into the wellbore after retracting the retractable segment of the tubular control conduit to cover the abandoned segment of the tubular control conduit.

17. The method of claim 16, wherein actuating the obstruction member is initiated by the retracting the retractable segment.

18. The method of claim 16, further comprising transmitting, prior to retracting the tubular control conduit, communication signals via the tubular control conduit.

* * * * *